US007881632B2

(12) United States Patent
Hasegawa

(10) Patent No.: US 7,881,632 B2
(45) Date of Patent: Feb. 1, 2011

(54) IMAGE FORMING APPARATUS FOR CONTROLLING FIXING OPERATION WITH AUXILIARY POWER SOURCE

(75) Inventor: Satoshi Hasegawa, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 332 days.

(21) Appl. No.: 11/862,785

(22) Filed: Sep. 27, 2007

(65) Prior Publication Data

US 2008/0112722 A1 May 15, 2008

Related U.S. Application Data

(60) Provisional application No. 60/865,075, filed on Nov. 9, 2006.

(30) Foreign Application Priority Data

Jun. 15, 2007 (JP) ..... 2007-158088

(51) Int. Cl.
*G03G 15/00* (2006.01)

(52) U.S. Cl. ..... 399/88; 399/70; 399/90

(58) Field of Classification Search ..... 399/69, 399/70, 88, 90

See application file for complete search history.

(56) References Cited

U.S. PATENT DOCUMENTS

| | | | | |
|---|---|---|---|---|
| 5,321,478 | A * | 6/1994 | Nakamura et al. | 399/70 |
| 6,542,705 | B2 * | 4/2003 | Fujita et al. | 399/69 |
| 7,343,113 | B2 * | 3/2008 | Matsusaka et al. | 399/69 |
| 7,496,312 | B2 * | 2/2009 | Sato et al. | 399/88 |
| 2005/0244170 | A1 * | 11/2005 | Ono et al. | 399/12 |
| 2008/0181623 | A1 * | 7/2008 | Hasegawa | 399/13 |

FOREIGN PATENT DOCUMENTS

| | | |
|---|---|---|
| JP | 2002-184554 | 6/2002 |
| JP | 2002-357966 | 12/2002 |

* cited by examiner

*Primary Examiner*—David M Gray
*Assistant Examiner*—Barnabas T Fekete
(74) *Attorney, Agent, or Firm*—Turocy & Watson, LLP

(57) ABSTRACT

In an embodiment of the invention, it is detected whether an auxiliary power source device is mounted in an apparatus main body or not. When the auxiliary power source device is mounted in the image forming apparatus, after a specified time has passed in a printable state, power supply to a first heat roller to heat a heat roller is shifted to a sleep mode. When the auxiliary power source device is not mounted in the image forming apparatus, after a specified time has passed in the printable state, a shift is made to a preheat mode in which the heat roller is kept at a preheat temperature, and a specified time has further passed, a shift is made to a sleep mode.

21 Claims, 17 Drawing Sheets

IMAGE FORMING APPARATUS FOR CONTROLLING FIXING OPERATION WITH AUXILIARY POWER SOURCE

CROSS REFERENCE TO RELATED APPLICATION

This invention is based upon and claims the benefit of priority from prior U.S. Patent Application 60/865,075 filed on Nov. 9, 2006 and Japanese Patent Application No. 2007-158088 filed on Jun. 15, 2007, the entire contents of which are incorporated herein by reference.

BACKGROUND OF THE INVENTION

1. Field of the Invention

The present invention relates to an image forming apparatus which controls a fixing operation for heating, pressing and fixing a toner image formed by a copier, a printer or the like to a recording medium.

2. Description of the Background

An image forming apparatus, such as an electrophotographic copier, printer or facsimile, includes a fixing device to heat, press and fix a toner image on a recording medium. As a system of the fixing device as stated above, there is a heat roller system in which a recording medium on which a toner image is formed is made to pass through a nip formed in a press contact part between a heat roller and a press roller, and the toner image is heated, pressed and fixed.

On the other hand, in recent years, there is growing awareness of environmental regulation or environmental protection. Thus, hitherto, there is an image forming apparatus in which power is supplied to a heat member only at the time of image formation, and when the image formation is not performed, power supply to a heat source of a heat roller is cut off, and energy saving is realized. However, in the image forming apparatus as stated above, although reduction in power consumption can be obtained, in a case where the heat capacity of the heat roller is large, at the time of image formation, the heat roller can not be immediately raised to a printable surface temperature (fixing temperature) and there is a fear that a long heating time is required before the image formation is started.

Thus, there is also an apparatus in which when image formation is not performed, a so-called preheat mode is held in which a heat roller is made to have a preheat temperature slightly lower than a printable temperature, and at the time of image formation, the heat roller can be immediately raised to the usable temperature. However, for further energy saving, it is also desired to save the consumption of power in the preheat mode.

Thus, hitherto, JP-A-2002-184554 discloses an image forming apparatus in which at the time of standby of an image formation operation, power is not supplied to a heat unit and the power is saved, and at the time of start of heating of the heat unit, a large capacity of power is supplied from both a main power source and an auxiliary power source device to raise the heat unit up to a specified temperature in a short time. However, since the auxiliary power source device is generally expensive, even if it takes a long time to raise the heat unit, some users do not desire to purchase the auxiliary power source device.

Then, an image forming apparatus is desired in which a user's option can be widened according to various user's desires in purchase conditions of the image forming apparatus, conditions of image formation function, and the like.

SUMMARY OF THE INVENTION

According to an aspect of the invention, a fixing operation is controlled so that a flexible measure can be taken concerning the presence or absence of necessity of an auxiliary power source device, and optimum power saving can be realized.

According to an embodiment of the invention, an image forming apparatus includes an apparatus main body having an image formation unit, a main power source unit that is mounted in the apparatus main body and supplies power to a heat source of a fixing device, and a control unit configured to switch a power supply operation of the main power source unit to the heat source of the fixing device according to whether an auxiliary power source unit to supply power to the heat source of the fixing device is mounted in the apparatus main body.

DETAILED DESCRIPTION OF THE PREFERRED EMBODIMENTS

Figure 1:
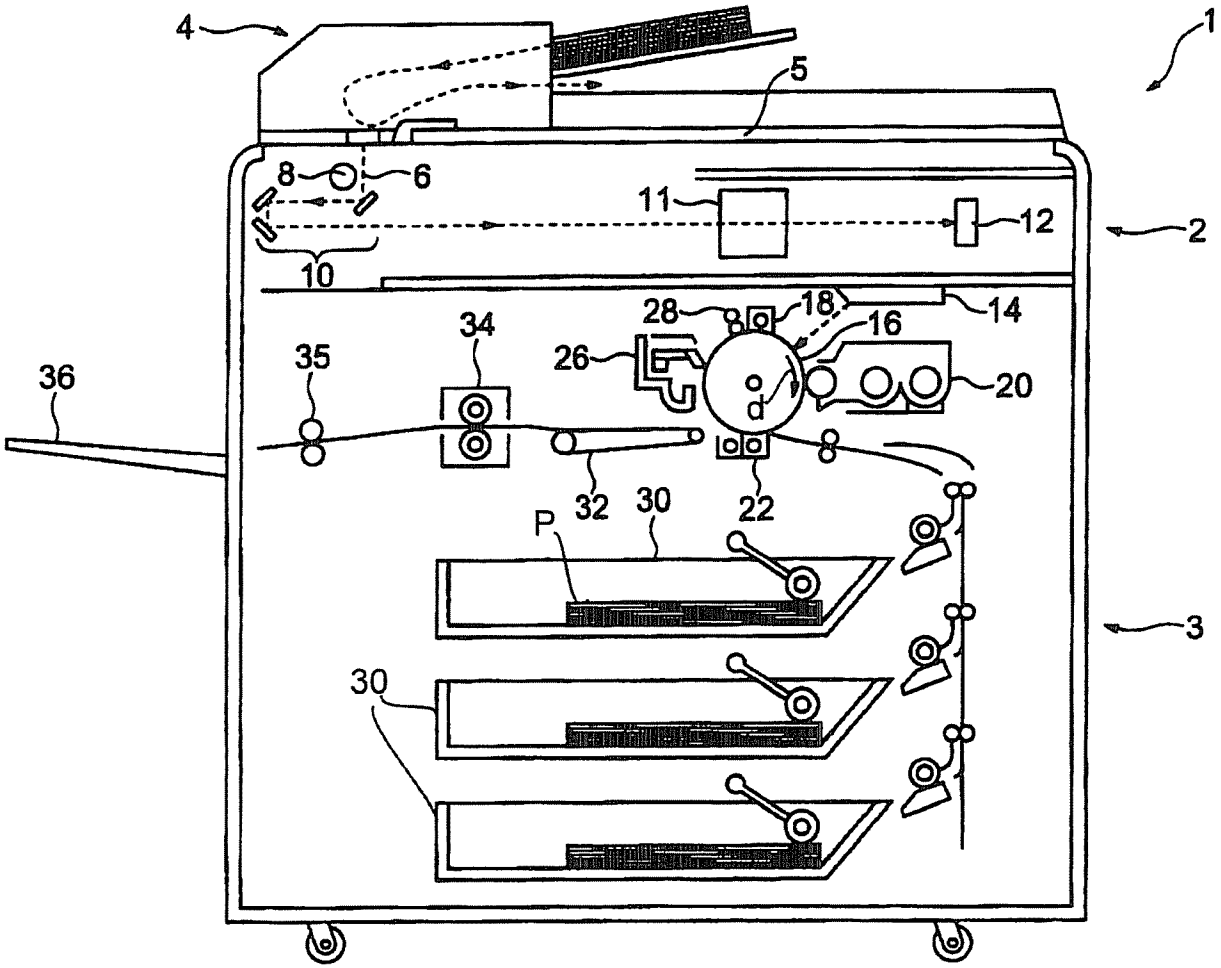
FIG. 1 is a schematic structural view sowing an image forming apparatus of a first embodiment of the invention.

Hereinafter, a first embodiment of the invention will be described in detail with reference to the accompanying drawings. FIG. 1 is a schematic structural view showing an image forming apparatus 1 as an apparatus main body of an embodiment of the invention. The image forming apparatus 1 includes a scanner unit 2 to read an original document and a printer unit 3 as an image formation unit to form an image.

The scanner unit 2 includes a transparent document mounting stand 5, a carriage 6, an exposure lamp 8 provided in the carriage 6, a reflecting mirror 10, an imaging lens 11 to converge reflected light, and a CCD 12 (Charge Coupled Device) to capture the reflected light and to convert image information of light into an analog signal. The printer unit 3 includes a photoconductive drum 16 and a laser unit 14 to form an electrostatic latent image on the photoconductive drum 16, and further includes a charging device 18, a developing device 20, a transfer device 22, a cleaner 26, and an electricity removal lamp 28 which are sequentially disposed at specified positions around the photoconductive drum 16, and plural paper feed devices 30 to supply a sheet P as a recording medium. Furthermore, the printer unit 3 includes a transport belt 32 to transport the sheet P on which a toner image is transferred by the transfer device 22, a fixing device 34, a paper discharge roller 35 and a paper discharge tray 36.

In the printer unit 3, when printing is started, the photoconductive drum 16 which is rotated in an arrow d direction is charged to a uniform potential by the charging device 18. Further, a laser beam corresponding to image information transmitted by the CCD 12 is irradiated by the laser unit 14 onto the photoconductive drum 16 which is rotated in the arrow d direction. By the irradiation of the laser beam, an electrostatic latent image corresponding to the image information of the original document is formed and held on the outer peripheral surface of the photoconductive drum 16. Next, toner is supplied by the developing device 20 to the outer peripheral surface of the photoconductive drum 16, and the electrostatic latent image is developed. By this, a toner image is formed on the outer peripheral surface of the photoconductive drum 16.

The toner image formed on the outer peripheral surface of the photoconductive drum 16 is electrostatically transferred by the transfer device 22 onto the sheet P transported by the paper feed device 30. After the transfer is ended, the sheet P on which the toner image is formed is transported to the fixing device 34 via the transport belt 32, and the toner image is heated, pressed and fixed onto the sheet P by the fixing device 34. The sheep P on which the toner image is fixed is discharged to the paper discharge tray 36 by the paper discharge roller 35. After the transfer is ended, residual toner remaining on the photoconductive drum 16 is removed by the cleaner 26, residual charge on the outer peripheral surface of the photoconductive drum 16 is removed by the electricity removal lamp 28, and next printing becomes possible.

Figure 2:
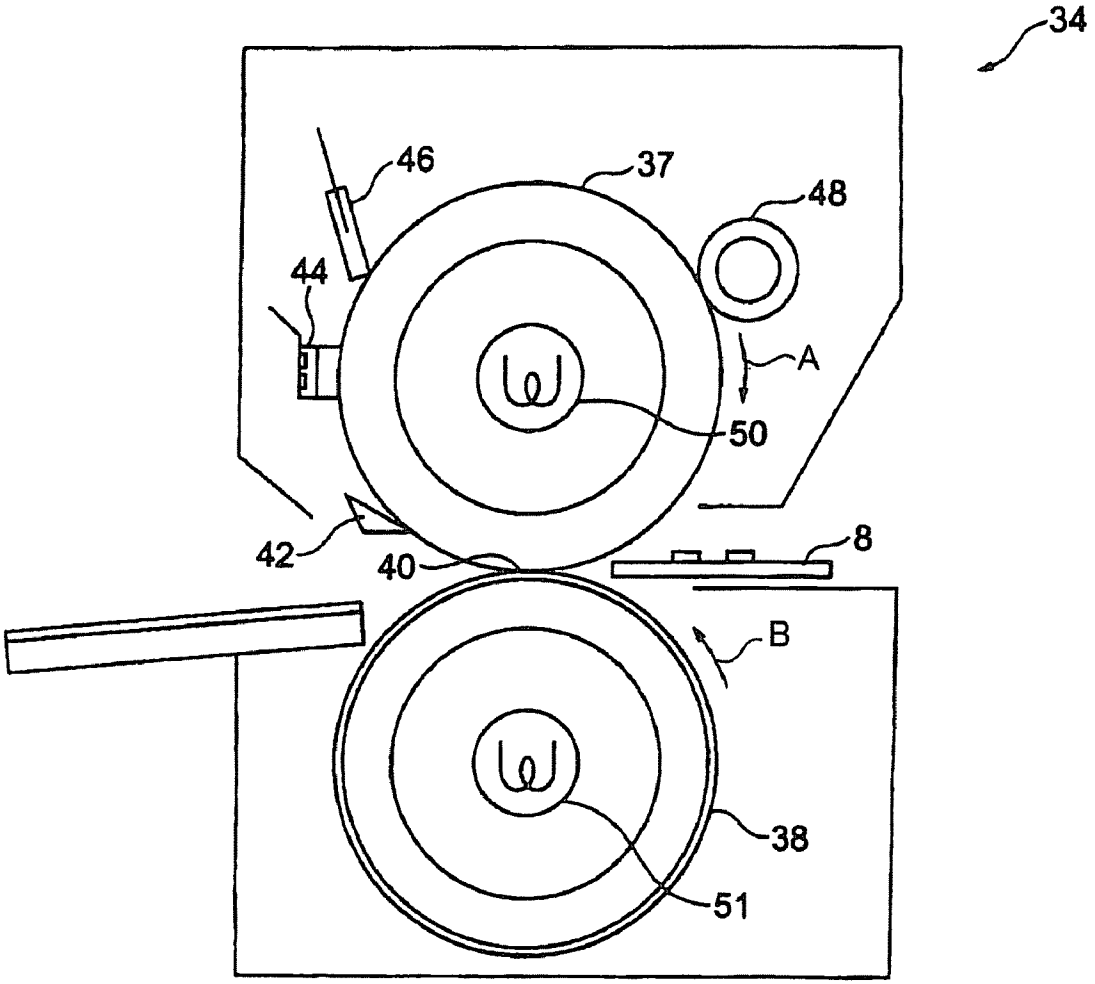
FIG. 2 is a schematic structural view showing a fixing device of the first embodiment of the invention.

Next, the fixing device 34 will be described. FIG. 2 is a schematic structural view showing the fixing device 34. The fixing device 34 includes a heat roller 37 and a press roller 38. The press roller 38 is disposed to face the heat roller 37, and is brought into press contact with the heat roller 37 by a well-known pressure mechanism. By this, a nip 40 having a definite width is formed which is a press contact part in which the heat roller 37 and the press roller 38 are in press contact with each other. At the time of printing, the heat roller 37 is rotated in an arrow A direction by a well-known drive motor. The press roller 38 is rotated in an arrow B direction in accordance with the heat roller 37.

Around the heat roller 37 and at the downstream side of the nip 40 in the rotation direction, a peel member 42 to peel the sheet P from the heat roller 37, a temperature detection member 44, such as a thermistor, to detect the surface temperature of the heat roller 37, a cleaning member 46 to remove toner or paper powder attached to the heat roller 37 from the surface of the heat roller 37, and a release agent application member 48 to apply a release agent such as silicone oil to the surface of the heat roller 37 are sequentially disposed.

A first heat 50 which is a heat source of the fixing device 34 and is made of, for example, a halogen lamp is disposed in the inside of the heat roller 37. The first heater 50 is supplied with power by a main power source device 67 which is a main power source unit to supply power from an after-mentioned main power source 201 in real time without charging.

Besides, a second heater 51 which is a heat source of the fixing device 34 and is made of a halogen lamp or the like is disposed in the inside of the press roller 38. The second heater 51 is incorporated in the press roller 38 irrespective of whether an after-mentioned auxiliary power source device 64 is mounted in the image forming apparatus 1 or not. However, the auxiliary power source device 64 for supplying power to the second heater 51 is, as an option, detachable from and attachable to the image forming apparatus 1.

In order to form the nip 40 at the contact part between the heat roller 37 and the press roller 38, the press roller 38 which is brought into press contact with the heat roller 37 is thick and has a large heat capacity. Thus, the press roller 38 is hard to heat. Further, since the heat roller 37 and the press roller 38 are in contact with each other, at the time of rising of the surface temperature of the heat roller 37, the heat of the heat roller 37 is absorbed by the press roller 38. In order to resolve these, the auxiliary power source device 64 supplies power to the second heater 51 at the time of rising of the surface temperature of the heat roller 37, and auxiliary heats the press roller 38. By doing so, it becomes possible to shorten the rising time of the surface temperature of the heat roller 37.

Incidentally, with respect to the heat source of the fixing device 34, as the first and the second heaters 50 and 51, for example, the halogen lamps or the like are used. However, the heat source of the fixing device 34 is not limited to the heater, and an exciting coil to which power is supplied from the main power source unit or the auxiliary power source unit may be used.

Figure 3:
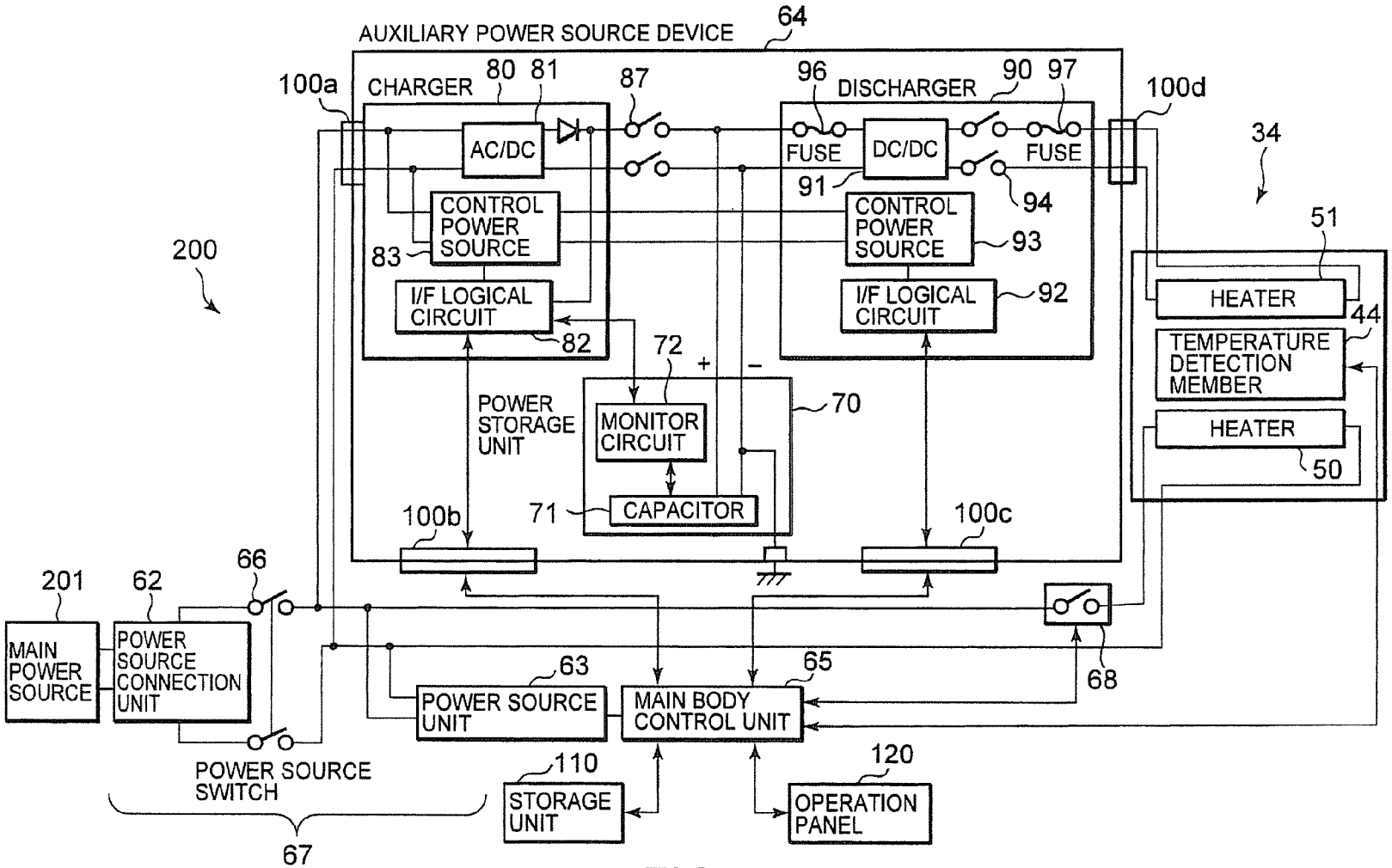
FIG. 3 is a schematic circuit view showing a circuit structure of a control unit for supplying power to a heat source of the fixing device of the first embodiment of the invention.

Next, a control unit 200 for supplying power to the heat source of the fixing device 34 will be described with reference to FIG. 3. The control unit 200 controls the operation of power supply to the first and the second heaters 50 and 51 of the fixing device 34. The main power source device 67 including a power source switch 66, a power source connection unit 62, and a power source unit 63 of the control unit 200 is connected to the first heater 50 of the fixing device 34. The main power source device 67 supplies the power of the main power source 201 such as, for example, a commercial power source to the first heater 50 of the fixing device 34. At this time, the power supply from the main power source 201 to the first heater 50 is turned on/off by a main switch 68 controlled by a main body control unit 65.

The power source unit 63 has a rectifying function of alternating current and direct current, and an adjustment function of power supplied from the main power source 201 to the first heater 50.

The main body control unit 65 is made of, for example, a CPU provided in the image forming apparatus 1, and operates by being supplied with power from the main power source 201 through the power source unit 63. The main body control unit 65 controls a high voltage power source necessary for printing of the image forming apparatus 1, controls a motor used for transport or the like of the sheet P, and controls an operation of the image forming apparatus 1. Further, the main body control unit 65 performs on/off control of the main switch 68 or variable control. Further, the main body control unit 65 performs control of a charger I/F logical circuit 82 or a discharger I/F logical circuit 92 in a charger 80 or a discharger 90 through a second connection unit 100*b* or a third connection unit 100*c*, grasping of the charge amount of a capacitor 71 through a monitor circuit 72, and on-off control of a first switch 87 and a second switch 94 of the after-mentioned auxiliary power source device 64. Besides, the main body control unit 65 is connected with a storage unit 110 for storing various settings, and an operation panel 120 which is a display unit and an operation unit for displaying various messages and for performing instructions of start/stop of printing and various settings. The main body control unit 65 performs various controls based on information stored in the storage unit 110 and instructions from the operation panel 120.

The auxiliary power source device 64 of the control unit 200 is an option, and in a case where the auxiliary power source device 64 is mounted in the image forming apparatus 1, power can be supplied to the second heater 51 at the time of warming-up of the image forming apparatus 1 or at the time of rising from the sleep state.

The auxiliary power source device 64 includes first to fourth connection units 100*a*, 100*b*, 100*c* and 100*d*. The auxiliary power source device 64 is detachably attached to the image forming apparatus 1 through the first to the fourth connection units 100*a*, 100*b*, 100*c* and 100*d*.

The auxiliary power source device 64 includes a power storage unit 70 to which power is charged, the charger 80 as a charge member to charge power to the power storage unit 70 from the main power source 201, and the discharger 90 as a discharge member to discharge and supply the power of the power storage unit 70 to the second heater 51. The auxiliary power source device 64 has a unit structure provided with a circuit necessary for heating the second heater 51 in a case where it is mounted in the image forming apparatus 1. Only in the case where the auxiliary power source device 64 is attached to the image forming apparatus 1, the second heater 51 can generate heat. On the other hand, even in the case where the auxiliary power source device 64 is not mounted in the image forming apparatus 1, all functions necessary for printing except the heat generation function of the second heater 51 are provided in the image forming apparatus 1.

The power storage unit 70 of the auxiliary power source device 64 includes the capacitor 71 as a power storage member and the monitor circuit 72 to detect the charge amount of the capacitor 71. Incidentally, as the power storage member, for example, a secondary battery or the like can be used.

The charger 80 includes an AC/DC converter 81 to convert AC current from the main power source 201 into DC current, the charger I/F (interface) logical circuit 82 electrically connected to the main body control unit 65 through the second connection unit 100*b*, and a charging control power source 83 for driving the charger I/F logical circuit 82. The charger 80 has a function to charge power to the capacitor 71 of the power storage unit 70 through the first switch 87. The charger 80 is connected to the main power source 201 through the first connection unit 100*a*, the power source switch 66 and the power source connection unit 62.

The discharger 90 includes a DC/DC converter 91 for uniformly discharging the DC current from the power storage unit 70, the charger I/F (interface) logical circuit 92 electrically connected to the main body control unit 65 through the third connection unit 100*c*, a discharging control power source 93 for driving the charger I/F logical circuit 92, and the second switch 94 for switching between the DC/DC converter 91 and the fourth connection unit 100*d*. The discharger 90 has a function to discharge the power, which has been charged in the capacitor 71 of the power storage unit 70, with constant DC current to the second heater 51 through the fourth connection unit 100*d*. Further, the discharger 90 includes fuses 96 and 97 to cut off an excessive current.

In the auxiliary power source device 64, power to each circuit, such as the charger I/F logical circuit 82 or the discharger I/F logical circuit 92, is supplied by the charging control power source 83 or the discharging control power source 93 provided in the auxiliary power source device 64. That is, the auxiliary power source device 64 is unitized to the utmost, and what can be provided at the auxiliary power source device 64 side is provided at the auxiliary power source device 64 side, not the image forming apparatus 1 side. As stated above, power supply to each circuit or equipment of the auxiliary power source device 64 is performed by the charging control power source 83 or the discharging control power source 93 provided in the auxiliary power source device 64, and accordingly, it is unnecessary to excessively increase the capacity of the power source unit 63 provided in the image forming apparatus 1.

Accordingly, it becomes possible to provide necessary performance at low cost to the user who does not require the auxiliary power source device 64. Further, the auxiliary power source device 64 can be easily provided as an option to the user who did not require the auxiliary power source device 64 at first and later desires mounting of the auxiliary power source device 64. As a result, it becomes possible to flexibly cope with various demands of users. However, the power supply to each circuit or equipment of the auxiliary power source device 64 is not performed by the control power source 83, 93 in the auxiliary power source device 64, but may be performed from the power source unit 63 at the image forming apparatus 1 side. By doing so, it becomes possible to adopt a structure more suitable for the specifications of the image forming apparatus 1.

When the auxiliary power source device 64 as the option is mounted in the image forming apparatus 1, the first connection unit 100*a* is connected to the power source switch 66, the second connection unit 100*b* and the third connection unit 100*c* are connected to the main body control unit 65, and the fourth connection unit 100*d* is connected to the second heater 51. The main body control unit 65 detects these connections and detects that the auxiliary power source device 64 is mounted in the image forming apparatus 1, and further controls charging and discharging of the auxiliary power source device 64 through the charger I/F logical circuit 82 and the discharger I/F logical circuit 92.

In the case where the auxiliary power source device 64 is mounted in the image forming apparatus 1, and the first to the fourth connection units 100*a*, 100*b*, 100*c* and 100*d* are respectively connected to the power source switch 66, the main body control unit 65 and the heater 51, the charger 80 converts AC current from the main power source 201 into DC current by the AC/DC converter 81 and can apply it to the capacitor 71.

At the time of charging of the capacitor 71, the first switch 87 is turned on, and the second switch 94 is turned off to form a circuit including the charger 80 and the power storage unit 70. Whether the capacitor 71 is being charged or not can be grasped by the main body control unit 65 from, for example, the on and off states of the first and the second switches 87 and 94 or the charge amount of the capacitor 71. Besides, the charge amount of the capacitor 71 is grasped by the main body control unit 65 through, for example, the monitor circuit 72 for measuring the voltage of the terminal of the capacitor 71, the charger I/F logical circuit 82 and the second connection unit 100*b*. The main body control unit 65 controls the charging of the auxiliary power source device 64 based on the charge amount of the capacitor 71 and the operation state of the image forming apparatus 1.

On the other hand, in the case where power is supplied to the second heater 51, the main body control unit 65 turns off the first switch 87, and turns on the second switch 94. The discharge from the capacitor 71 to the second heater 51 becomes possible by the circuit including the power storage unit 70, the discharger 90 and the second heater 51. The DC/DC converter 91 keeps the power from the capacitor 71, which decreases with the passage of the discharge, constant. Accordingly, the power supplied from the discharger 90 to the second heater 51 through the fourth connection unit 100*d* becomes constant.

Next, the operation of power supply to the first and the second heaters 50 and 51 of the fixing device 34 of the image forming apparatus 1 will be described with reference to flowcharts shown in FIG. 4 to FIG. 8. Incidentally, the operation state of the image forming apparatus 1 adopting the heat roller system includes (1) a print mode for performing printing, (2) a standby mode for standing by in a state where the surface temperature of the heat roller 37 is kept at a specified fixing temperature and printing can be immediately performed in a case where a print instruction is issued, (3) a preheat mode in which when a specified time has passed in the standby mode, the surface temperature of the heat roller 37 is kept at a specified preheat temperature lower than the fixing temperature, and in a case where a print instruction is issued, the surface temperature of the heat roller 37 is immediately raised to the printable surface temperature (fixing temperature), and (4) a sleep mode in which when a specified time has passed in the standby mode or the preheat mode, power supply to the first heater 50 is cut off, and in the case where a print instruction is issued, the surface temperature of the heat roller 37 is immediately raised to the fixing temperature. In the case where the auxiliary power source 64 is mounted in the image forming apparatus 1, when the operation state of the image forming apparatus 1 is in the standby mode, charging of the capacitor 71 of the auxiliary power source device 64 is performed.

Figure 4:
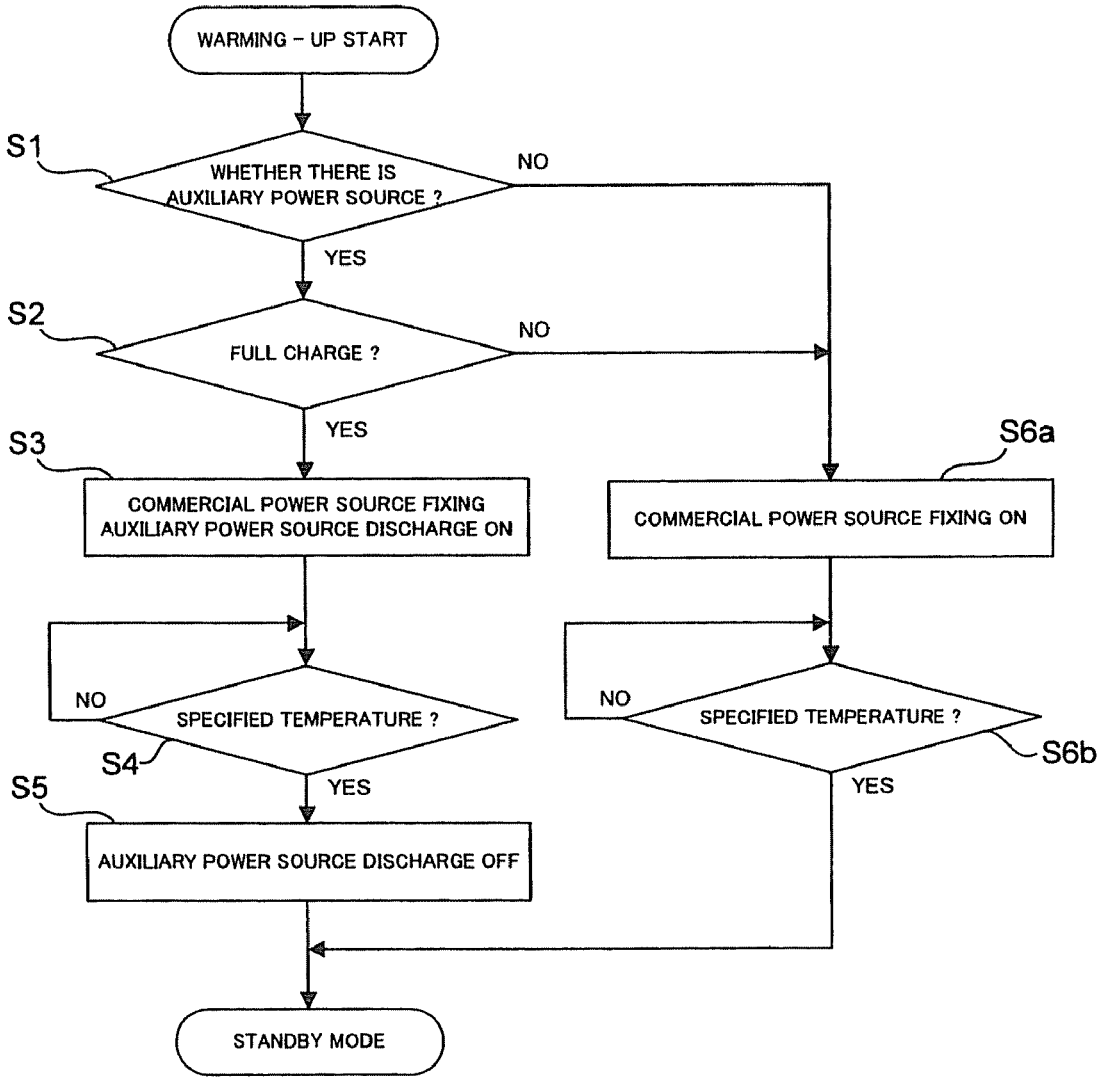
FIG. 4 is a flowchart showing an operation at the time of warming-up of the image forming apparatus of the first embodiment of the invention.

First, the operation at the time of warming-up of the image forming apparatus 1 will be described with reference to the flowchart of FIG. 4. The warming-up is started when the main power source 201 of the image forming apparatus 1 is turned on or return is made from the sleep mode. When the warming-up is started, the main body control unit 65 detects the presence or absence of mounting of the auxiliary power source 64 (step S1). At this time, the presence or absence of mounting of the auxiliary power source device 64 may be displayed on, for example, the operation panel 120. The display on the operation panel 120 is performed in an arbitrary manner by using characters, illustrations or the like. In the case where the auxiliary power source device 64 is mounted in the image forming apparatus 1, and the main body control unit 65 detects the auxiliary power source device 64 at step S1, the main body control unit 65 determines the charge amount of the capacitor 71 through the monitor circuit 72 (step S2).

In the case where the capacitor 71 is fully charged, power is supplied from the main power source device 67 to the first heater 50, and power of the capacitor 71 of the auxiliary power source device 64 is supplied to the second heater 51 through the discharger 90 (step S3). By this, heating of the heat roller 37 and the press roller 38 is started. The power supply from the main power source device 67 and the auxiliary power source device 64 to the first heater 50 and the second heater 51 is continued until the surface temperature of the heat roller 37 becomes the specified fixing temperature (step S4).

When the temperature detection member 44 detects that the surface temperature of the heat roller 37 reaches the specified fixing temperature, the power supply from the auxiliary power source device 64 to the second heater 51 is stopped (step S5). At this time, the heat roller 37 is brought into a state in which printing can be immediately performed, and thereafter, a shift is made to the standby mode in which printing can be immediately performed in the case where a print instruction is issued. In this standby mode, the power supply to the first heater 50 is controlled so that the surface temperature of the heat roller 37 is kept at the specified fixing temperature.

On the other hand, at step S1, in the case where the main body control unit 65 does not detect the auxiliary power source device 64, or at step S2, the capacitor 71 is not fully charged, only the power supply to the first heater 50 by the main power source device 67 is performed (step S6*a*). By this, heating of the heat roller 37 is started. When it is detected that the surface temperature of the heat roller 37 reaches the specified fixing temperature (step S4), thereafter, a shift is made to the standby mode in which the power supply to the first heater 50 is controlled so that the surface temperature of the heat roller 37 is kept at the specified fixing temperature.

Figure 5:
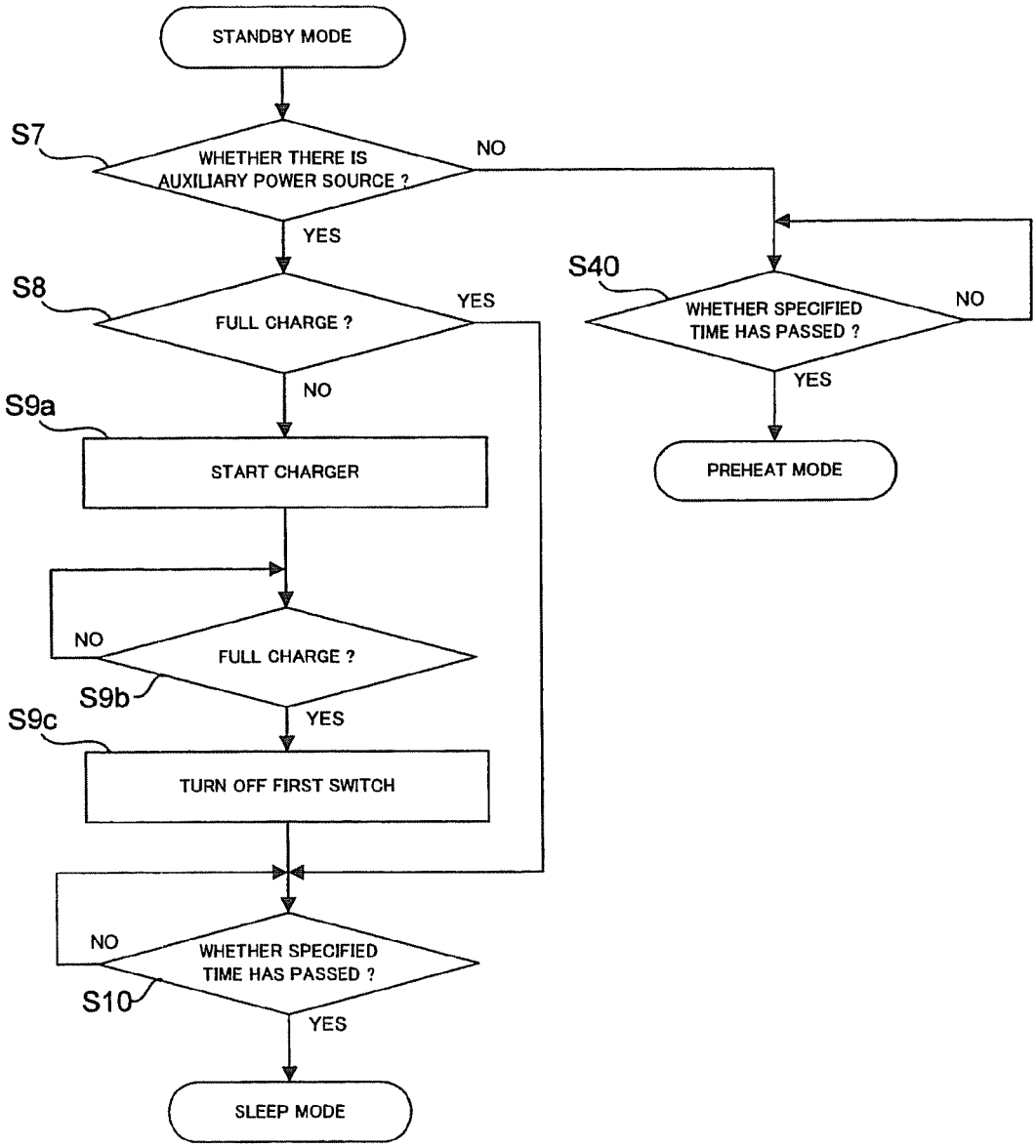
FIG. 5 is a flowchart showing an operation of an auxiliary power source device of the first embodiment of the invention at the time of charging.

Next, the operation at the time of charging of the auxiliary power source device 64 will be described with reference to the flowchart of FIG. 5. Incidentally, in FIG. 5, the description will be made on the assumption that a print instruction is not issued during a period when the standby mode is held. During the period when the image forming apparatus 1 holds the standby mode, the main body control unit 65 determines the presence or absence of mounting of the auxiliary power source device 64 (step S7). At step S7, in the case where the mounting of the auxiliary power source device 64 is detected, the main body control unit 65 determines the charge amount of the capacitor 71 (step S8). In the case where the capacitor 71 is not fully charged, the main body control unit 65 turns on the first switch 87 to start the charger 80, and the capacitor 71 is charged (step S9*a*).

Figure 7:
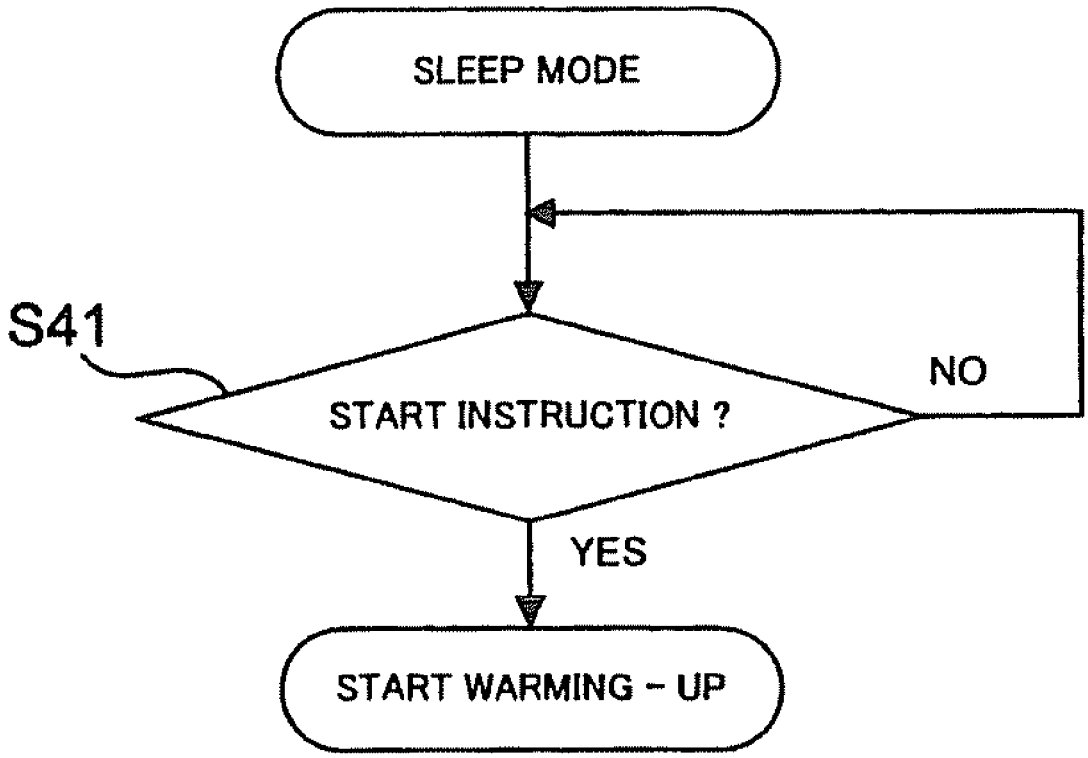
FIG. 7 is a flowchart showing monitoring of a print interrupt during a sleep mode of the first embodiment of the invention.

Next, when it is determined that the capacitor 71 reaches full charge (step S9*b*), the first switch 87 is turned off and the charging operation of the capacitor 71 is ended (step S9*c*). Thereafter, it is determined whether a specified time has passed in the standby mode (Step S10) In the case where the specified time has passed in the standby mode, power supply to the first heater 50 is cut off and then, a shift is made to the sleep mode. During the sleep mode, as shown in the flowchart of FIG. 7, a print mode interrupt is monitored. At step S41, it is determined whether a start instruction of the image forming apparatus 1 is issued. In the case where the start instruction is issued, the warming-up shown in FIG. 4 is started.

Figure 8:
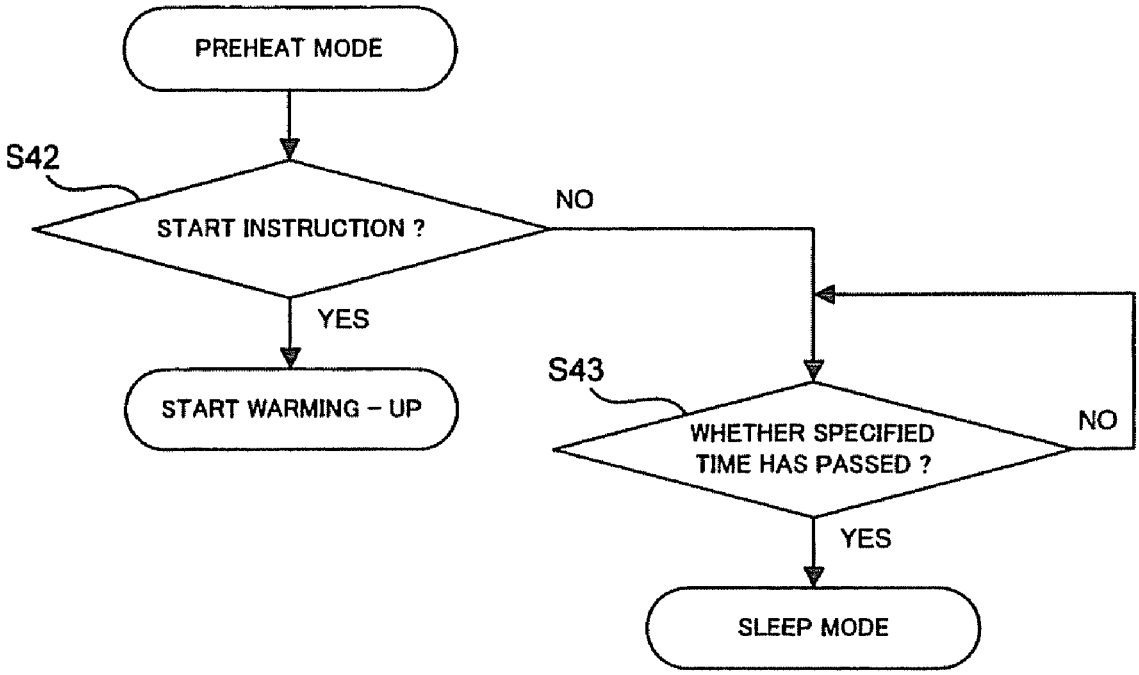
FIG. 8 is a flowchart showing monitoring of a print interrupt during a preheat mode of the first embodiment of the invention.

On the other hand, at step S7, in the case where the main body control unit 65 does not detect the auxiliary power source device 64, it is determined whether a specified time has passed in the standby mode (step S40). In the case where the specified time has passed in the standby mode, the power supply to the first heater 50 is controlled so that the surface temperature of the heat roller 37 is kept at a specified preheat temperature lower than the fixing temperature, and then, a shift is made to the preheat mode. During this preheat mode, as shown in the flowchart of FIG. 8, the print mode interrupt is monitored. At step S42, it is determined whether the start instruction of the image forming apparatus 1 is issued. In the case where the start instruction is issued, the warming-up shown in FIG. 4 is started. In the case where the start instruction is not issued at step S42, and then in the case where it is determined at step S43 that a specified time has passed in the state of the preheat mode, the power supply to the first heater 50 is cut off, and a shift is made to the sleep mode.

Incidentally, the specified time required for the shift from the stand by mode to the sleep mode or the preheat mode is not limited, and can also be set by the operation panel 120 or the like. Besides, the specified time can be detected in such a manner that the main body control unit 65 checks a timer or the like.

Figure 6:
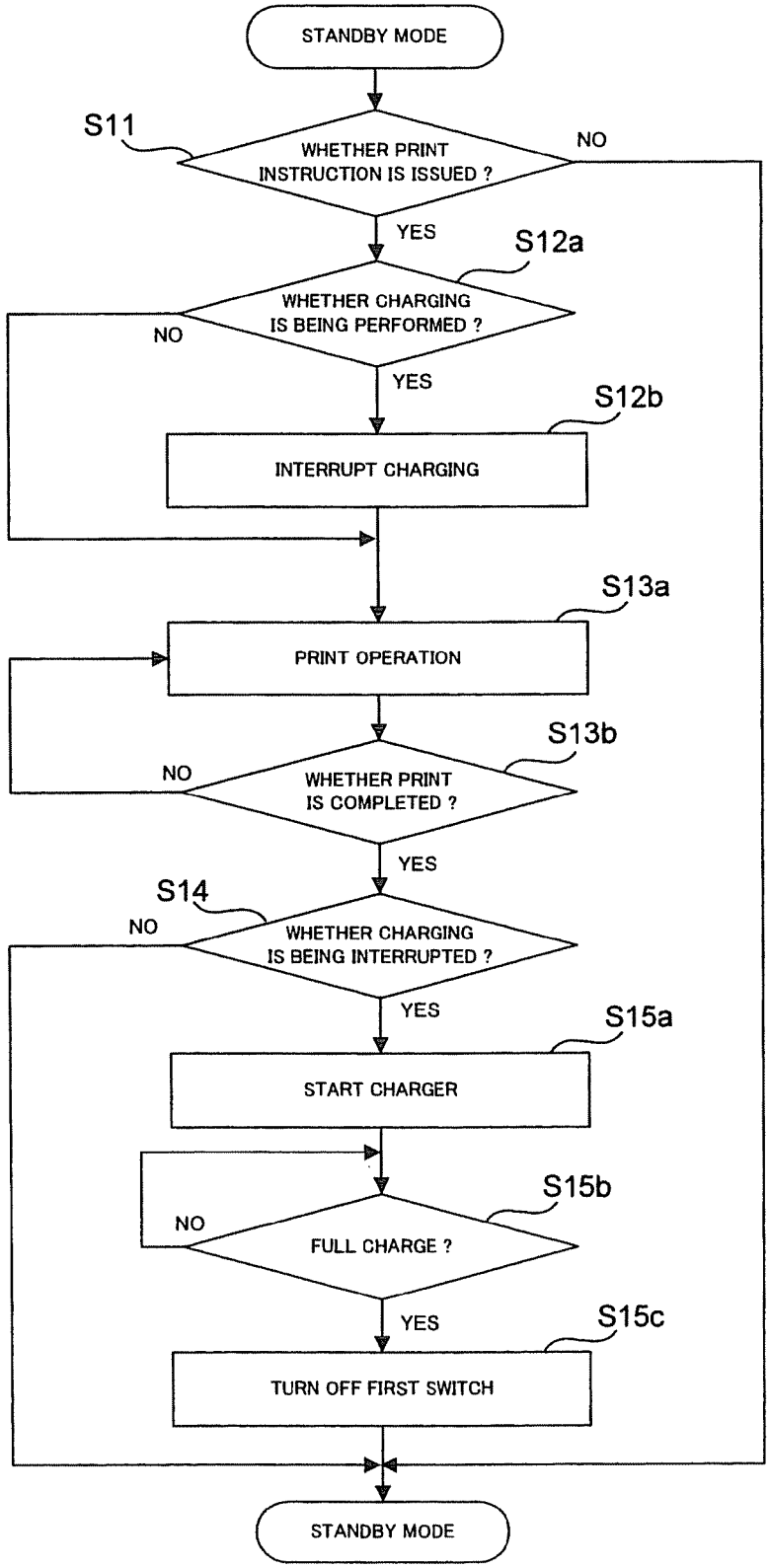
FIG. 6 is a flowchart showing an operation of the auxiliary power source device at the time of charging in a case where a print instruction is issued in a standby mode of the first embodiment of the invention.

Next, an operation at the time of charging of the auxiliary power source device 64 in the case where the print instruction is issued during the standby mode will be described with reference to the flowchart of FIG. 6. The print instruction is interruptible also in the preheat mode or the sleep mode other than the standby mode. It is determined whether the print instruction is issued during the standby mode (step S11). In the case where the print instruction is issued at step S11, the main body control unit 65 determines whether the capacitor 71 is being charged (step S12*a*). When the capacitor 71 is being charged, the main body control unit 65 turns off the first switch 87 to cut off the charging (step S12*b*). A shift is made to the print mode and printing is performed (step S13*a*).

When it is determined at step S13*b* that image formation is completed, it is determined whether the capacitor 71 is in the state where charging is interrupted (step S14). Whether the charging of the capacitor 71 is interrupted or not is determined on the basis of the charge amount of the capacitor 71 grasped by the main body control unit 65 through the monitor circuit 72. In the case where the capacitor 71 is not fully charged, it is determined that the charging of the capacitor 71 is interrupted by the print instruction, and the main body control unit 65 turns on the first switch 87 to start the charger 80, and the charging of the capacitor 71 is performed (step S15*a*) Next, when it is determined that the capacitor 71 reaches full charge (step S15*b*), the first switch 87 is turned off and the charging operation of the capacitor 71 is ended (step S15*c*).

After the full charge is completed, or in the case where a print instruction is not issued at step S11, thereafter, the standby mode is kept. Incidentally, in the case where image formation is continuously performed at the time of printing of step S13*a*, and unevenness occurs in the axial direction temperature distribution of the roller surface of the heat roller 37 or the press roller 38, it is also possible to adjust the axial direction temperature distribution of the roller surface by further performing power supply from the main power source device 67 or the auxiliary power source device 64 to the first heater 50 or the second heater 51.

Figure 9:
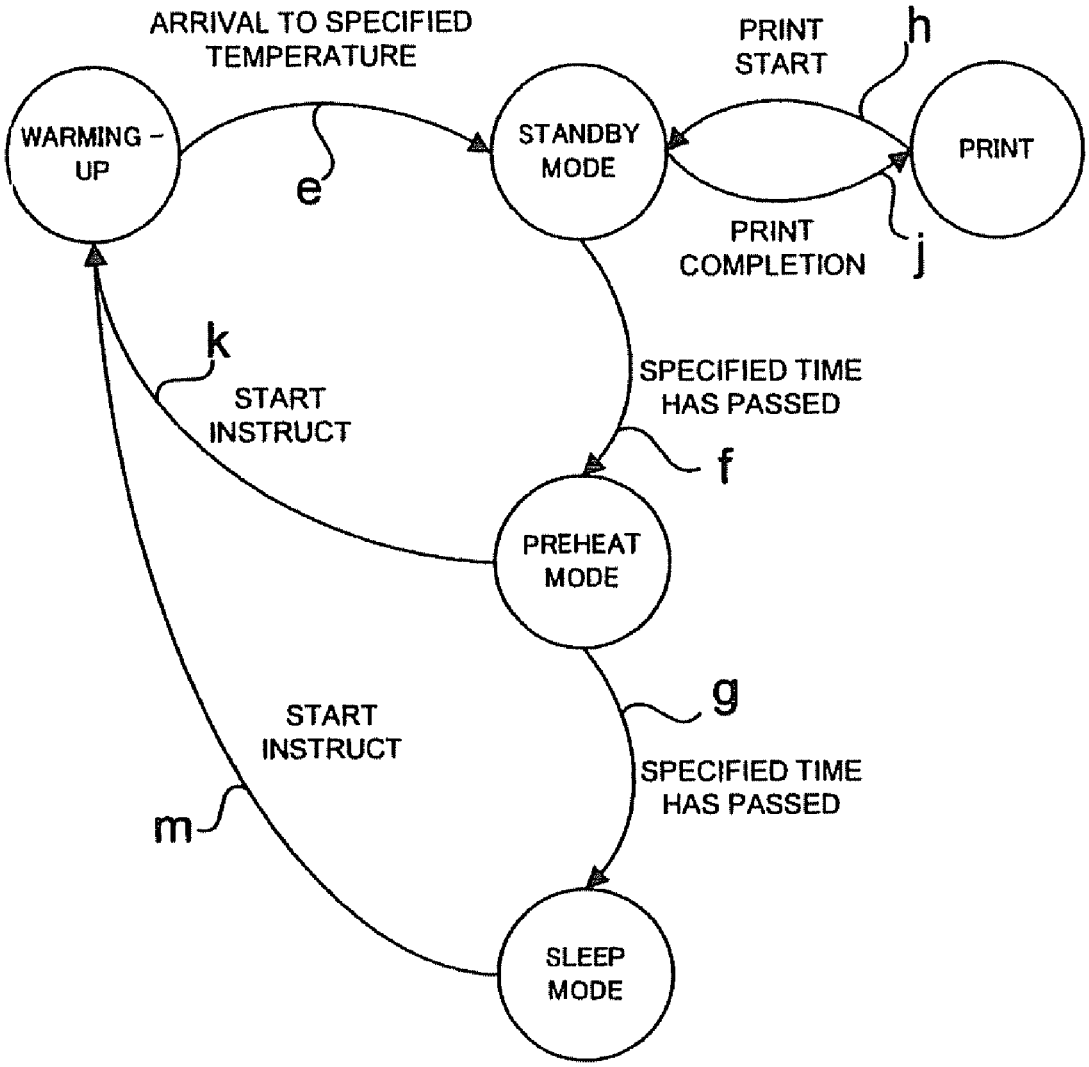
FIG. 9 is a transition view showing an operation of the image forming apparatus in a case where the auxiliary power source device is not mounted in the image forming apparatus of the first embodiment of the invention.

That is, in this first embodiment, in the case where the auxiliary power source device 64 is not mounted, the image forming apparatus 1 operates as shown in a transition view of FIG. 9. In FIG. 9, when the heat roller 37 reaches the specified fixing temperature by warming-up in which power is supplied to the first heater 50, the image forming apparatus 1 shifts to the standby mode as indicated by an arrow e, the printable state is held, and waiting is made for the print instruction. Thereafter, when the specified time has passed while the print instruction is not issued, the image forming apparatus 1 shifts to the preheat mode as indicated by an arrow f, and keeps the heat roller 37 at the preheat temperature lower than the specified fixing temperature. Further, when the specified time has passed while the print instruction is not issued, the image forming apparatus 1 shifts from the preheat mode to the sleep mode as indicated by an arrow g.

On the other hand, when the print instruction is received in the standby mode, the image forming apparatus 1 immediately starts printing as indicated by an arrow h. When printing is completed, a shift is made to the standby mode as indicated by an arrow j. In the case where the print instruction is received in the preheat mode other than the standby mode, as indicated by an arrow k, a shift is made to the warming-up by the start instruction. In the case where the print instruction is received in the sleep mode, as indicated by an arrow m, a shift is made to the warming-up by the start instruction. When the heat roller 37 reaches the specified fixing temperature by the warming-up, the image forming apparatus 1 shifts to the standby mode as indicated by the arrow e, and immediately starts printing.

Figure 10:
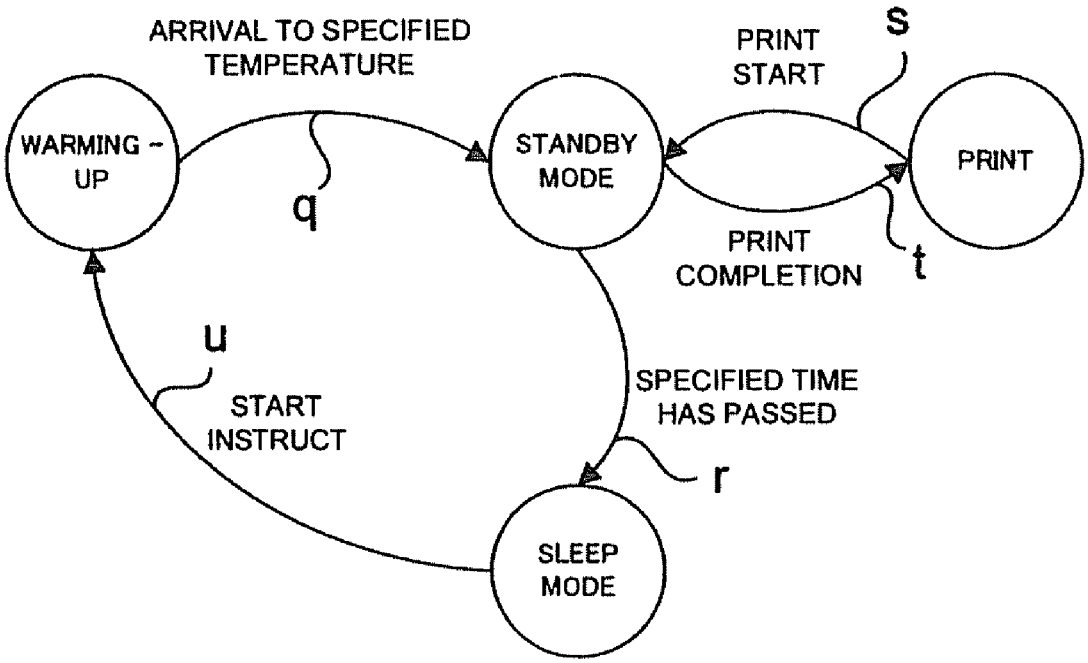
FIG. 10 is a transition view showing an operation of the image forming apparatus in a case where the auxiliary power source device is mounted in the image forming apparatus of the first embodiment of the invention.

In the first embodiment, in the case where the auxiliary power source device 64 is mounted, the image forming apparatus 1 operates as shown in a transition view of FIG. 10. In FIG. 10, in the case where the capacitor 71 is fully charged, when the heat roller 37 reaches the specified fixing temperature by warming-up in which power is supplied to the first heater 50 and the second heater 52, the image forming apparatus 1 shifts to the standby mode as indicated by an arrow q, holds the printable state, and waits for the print instruction. Besides, the capacitor 71 is charged during the standby mode. Thereafter, when the specified time has passed while the print instruction is not issued, the image forming apparatus 1 shifts to the sleep mode as indicated by an arrow r. When the print instruction is received in the standby mode, the image forming apparatus 1 immediately starts printing as indicated by an arrow s. When printing is completed, as indicated by an arrow t, a shift is made to the standby mode. In the case where the print instruction is received in the sleep mode, as indicated by an arrow u, a shift is made to the warming-up by the start instruction. When the heat roller 37 reaches the specified temperature by the warming-up in which power is supplied to the first heater 50 and the second heater 52, the image forming apparatus 1 shifts to the standby mode as indicated by an arrow q, and immediately starts printing.

In the case where the auxiliary power source 64 is mounted in the image forming apparatus 1, at the time of the warming-up, power is supplied to the first heater 50 and the second heater 52, and therefore, as compared with the case where the auxiliary power source 64 is not mounted, the rising time from the sleep mode can be shortened. Accordingly, in the case where the auxiliary power source 64 is mounted, when the specified time has passed in the standby mode, a shift is made to the sleep mode. That is, a shift is not made to the preheat mode, but is made directly from the standby mode to the sleep mode. By this, power consumed in the preheat mode becomes unnecessary, and power saving can be realized.

According to the image forming apparatus 1 of the first embodiment, the operation mode is controlled by the main body control unit 65 according to the presence or absence of the auxiliary power source device 64, the charge amount of the capacitor 71, and the state of the image forming apparatus 1. By this, the image forming apparatus 1 can cope with both the presence and absence of the auxiliary power source device 64.

That is, for example, even in the case where the user, who desired reduction of purchase cost at the time of purchase of the image forming apparatus 1 and did not require the auxiliary power source device 64, later attaches importance to the reduction of the warming-up time and the reduction of the amount of power consumption required in the preheat mode and requires the auxiliary power source device 64, the auxiliary power source device 64 as the option can be easily mounted in the image forming apparatus 1. Further, in the case where the auxiliary power source 64 is mounted in the image forming apparatus 1, power can be supplied to the second heater 51 by the auxiliary power source device 64 without exerting an influence on driving of devices other than the auxiliary power source device 64. Accordingly, it is possible to suitably satisfy demands of various users, such as the user who desires low cost at the time of purchase of the image forming apparatus 1, the user who desires energy saving, and the user who desires energy saving after purchase of the image forming apparatus 1, better service can be provided, and the optimum power saving at that time can be realized.

Besides, the auxiliary power source device 64 is attachable to and detachable from the image forming apparatus 1, and the operation mode of the image forming apparatus 1 is suitably controlled according to whether the auxiliary power source device 64 is mounted in the image forming apparatus 1 or is not mounted. That is, even if the auxiliary power source device 64 goes wrong, the image forming apparatus 1 can be controlled in the same operation mode as the case where the auxiliary power source device 64 is not mounted. That is, the image forming apparatus 1 can perform normal printing without being influenced by the broken auxiliary power source device 64. Accordingly, even if the auxiliary power source device 64 goes wrong, the image forming apparatus 1 is not brought down due to the failure of the auxiliary power source device 64, the operating efficiency can be improved, and the usability of the user can be improved.

Besides, in the first embodiment, the auxiliary power source device 64 is provided with the charging control power source 83 or the discharging control power source 93, and the auxiliary power source device 64 is unitized to the utmost. Accordingly, it becomes unnecessary to cause the capacity of the power source unit 63 provided in the image forming apparatus 1 to be excessively large for the case of mounting the auxiliary power source device 64. As a result, to the user who does not require the auxiliary power source device 64, it becomes possible to provide the required performance at low cost, and it becomes possible to provide the low cost image forming apparatus 1 at the time of purchase. Further, in the case where the auxiliary power source device 64 comes to be required during the use of the image forming apparatus 1, it is possible to easily provide the auxiliary power source device as the option to the user.

Incidentally, in this first embodiment, in the case where the capacitor 71 is fully charged, the power supply to the second heater 51 by the auxiliary power source 64 is performed. However, for example, when the charge capacity of the capacitor 71 is large, and a specified charge amount sufficient to supply the power required by the second heater 51 at the time of warming-up is charged, the capacitor 71 may not be fully charged. In such a case, the specified charge amount required for the capacitor 71 is stored in, for example, the storage device 110.

Besides, in this first embodiment, although the auxiliary power source device 64 is made to have a single unit structure, no limitation is made to this. In order to facilitate attachment to and detachment from the image forming apparatus 1, the auxiliary power source device 64 may be constructed to be capable of being separated into plural units.

Figure 11:
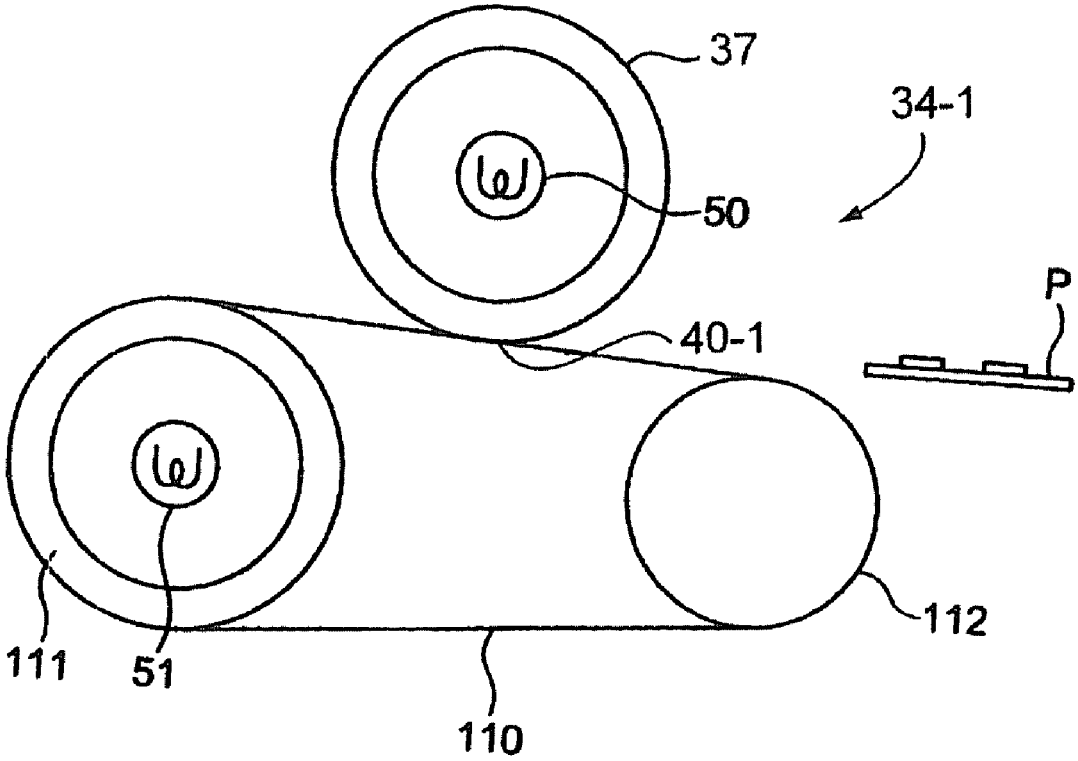
FIG. 11 is a schematic structural view showing a fixing device of a first modified example of the first embodiment of the invention.

Further, in this first embodiment, although the heat roller 37 and the press roller 38 are used as the heat press type fixing device 34, no limitation is made to this. For example, like a fixing device 34-1 shown in a first modified example of FIG. 11, instead of the press roller 38, a press belt 110 stretched between a first support roller 111 having a second heater 51 and a second support roller 112 may be used. In this fixing device 34-1, a heat roller 37 having a first heater 50 and the press belt 110 are in contact with each other at a given pressure, and a nip 40-1 is formed. A sheet P passes through this nip 40-1, so that a toner image is fixed. Incidentally, the second heater 51 may be arranged inside the second support roller 112.

Figure 12:
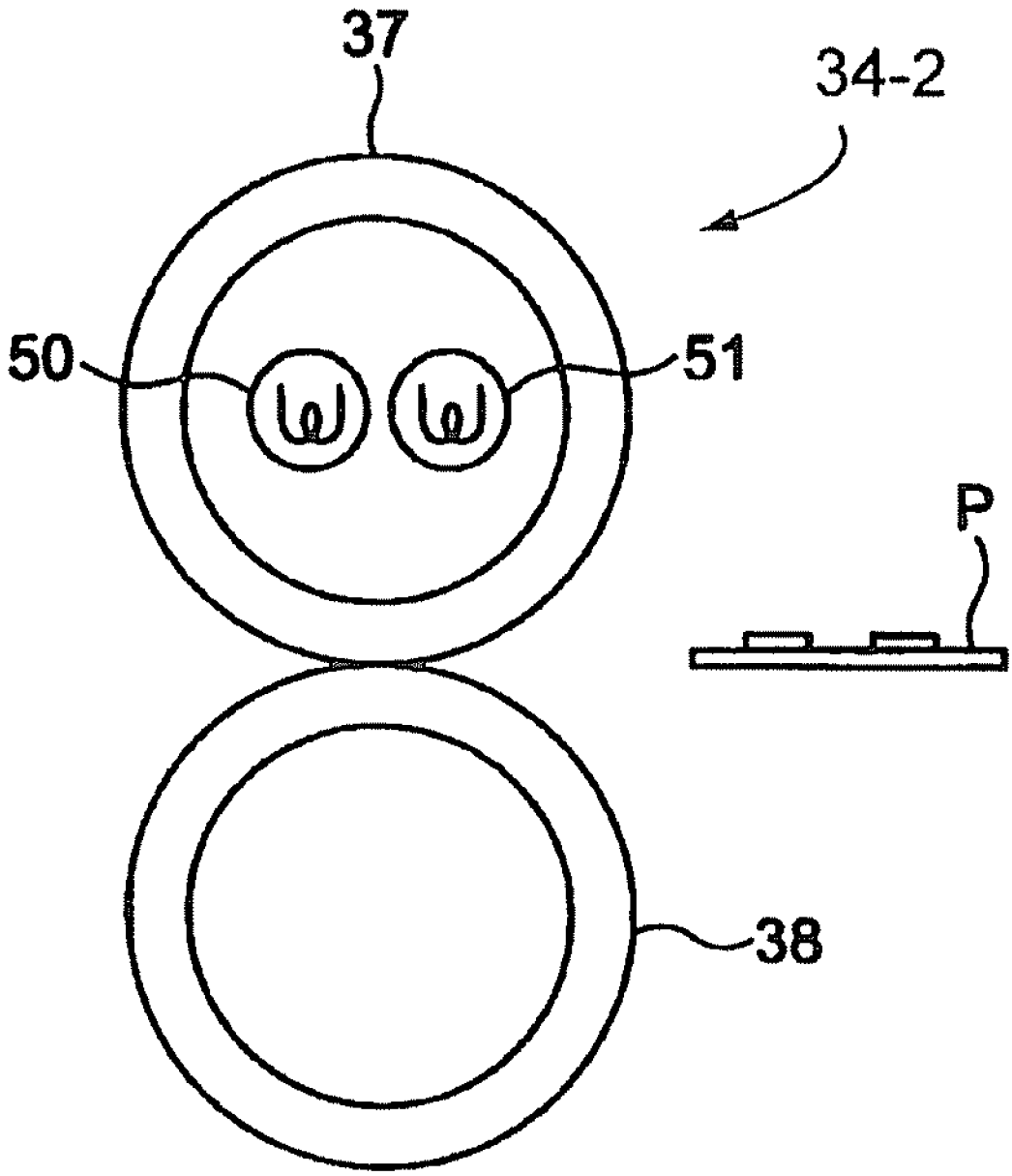
FIG. 12 is a schematic structural view showing a fixing device of a second modified example of the first embodiment of the invention.

Further, for example, like a fixing device 34-2 shown in a second modified example of FIG. 12, the second heater 51 to which power is supplied from the auxiliary power source device 64, together with the first heater 50 to which power is supplied from the main power source device 67, may be arranged inside the heat roller 37. Incidentally, in this case, it is unnecessary to contain plural heaters in the heat roller 37, and a structure may be made such that power is supplied from the main power source device 67 and the auxiliary power source device 64 to a single heater having the functions of the first heater 50 and the second heater 51.

Figure 13:
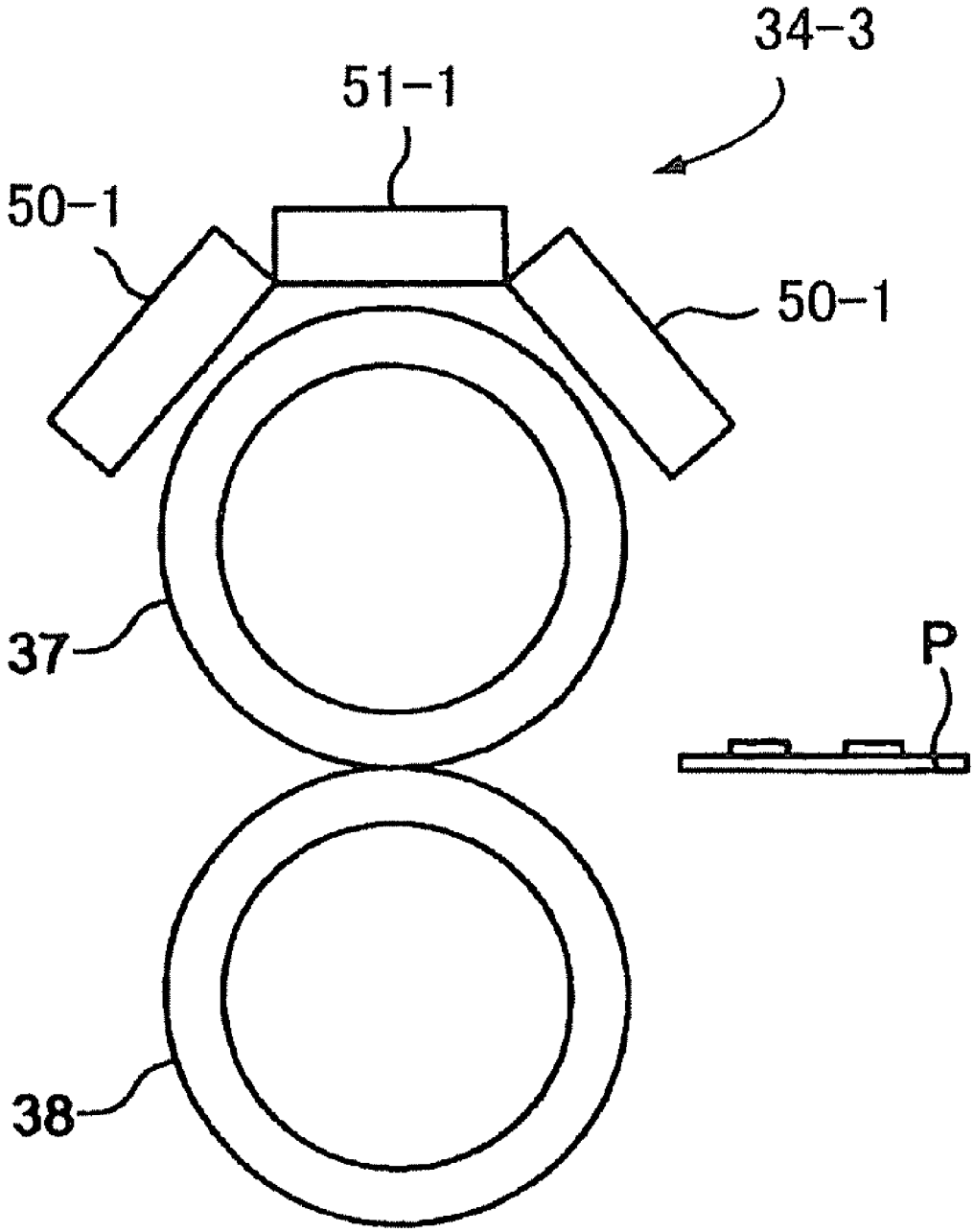
FIG. 13 is a schematic structural view showing a fixing device of a third modified example of the first embodiment of the invention.
Figure 14:
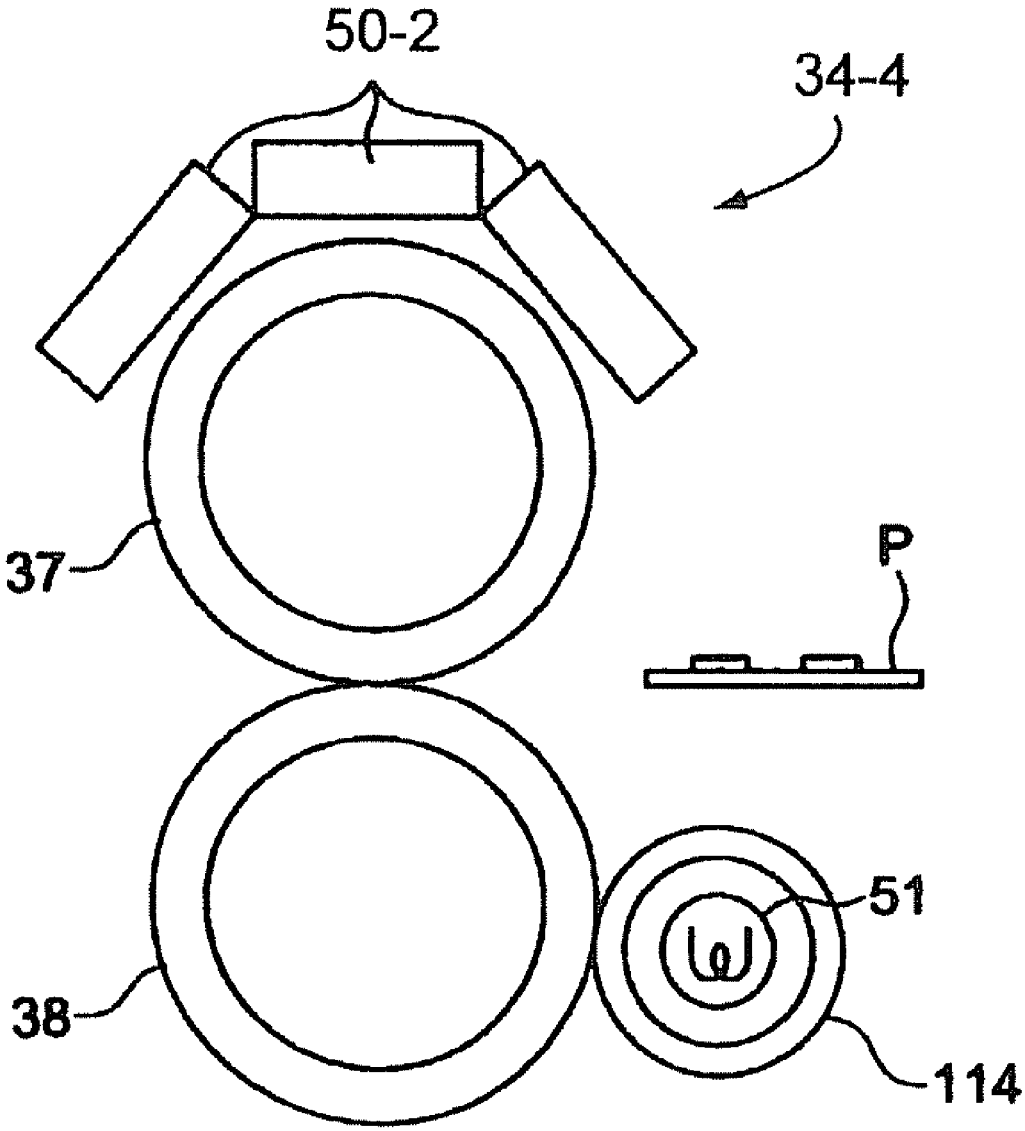
FIG. 14 is a schematic structural view showing a fixing device of a fourth modified example of the first embodiment of the invention.

Further, a heater may be arranged outside the heat roller 37 or the press roller 38. For example, like a fixing device 34-3 shown in a third modified example of FIG. 13, a first induction heating heater 50-1 to which power is supplied from the main power source device 67 and a second induction heating heater 51-1 to which power is supplied from the auxiliary power source device 64 may be arranged outside the heat roller 37. Further, a fixing device 34-4 shown in a fourth modified example of FIG. 14 may be adopted. In the fixing device 34-4, a first induction heating heater 50-2 to which power is supplied from the main power source device 67 is arranged outside the heat roller 37, and an auxiliary heat roller 114 having a second heater 51 to which power is supplied from the auxiliary power source device 64 is in contact with the press roller 38.

Next, a second embodiment of the invention will be described. In the second embodiment, setting of use or non-use of the auxiliary power source device in the first embodiment is performed, and the others are the same as the first embodiment. Accordingly, in this second embodiment, the same structures as structures described in the first embodiment are denoted by the same reference numerals and their detailed explanation will be omitted.

Figure 15:
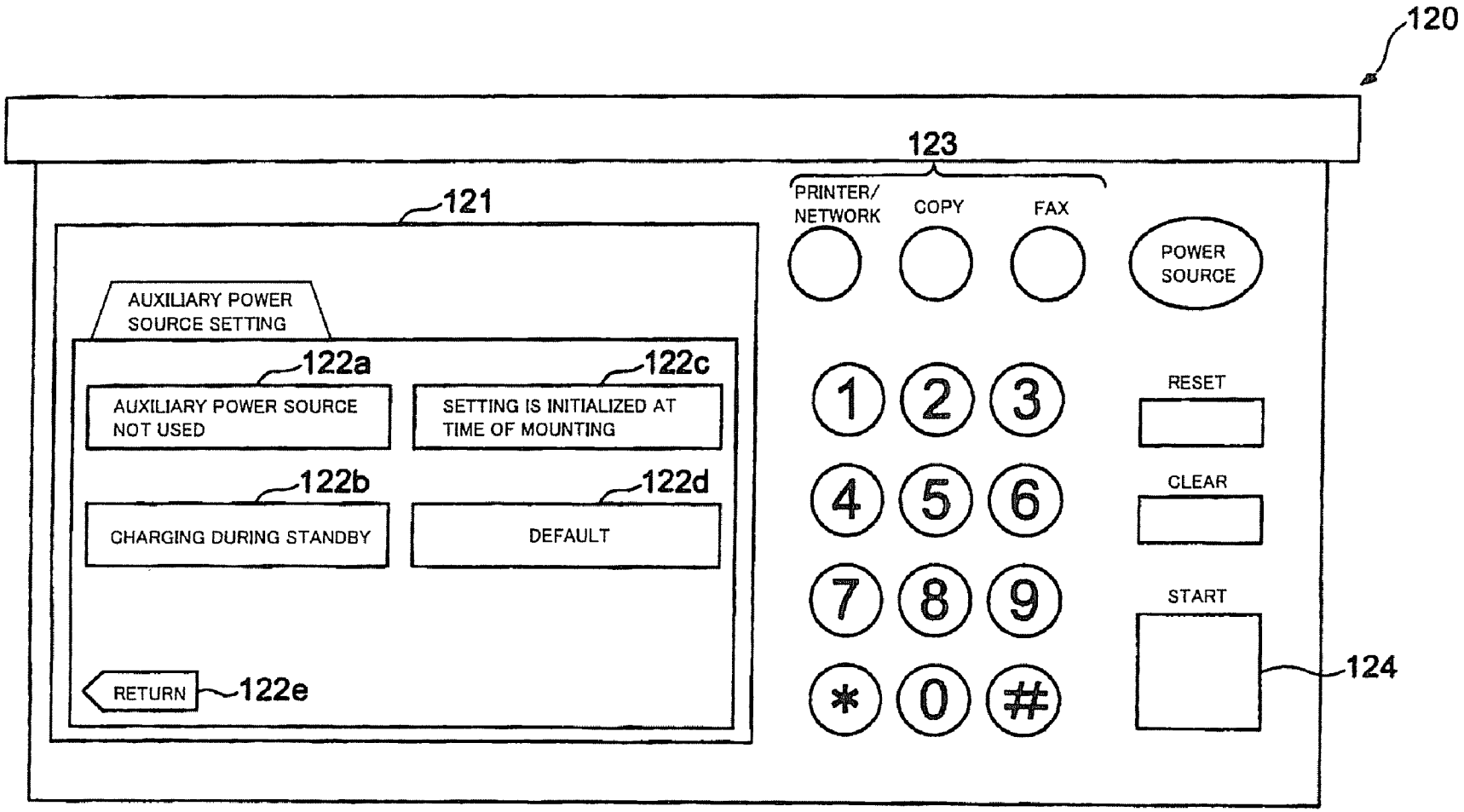
FIG. 15 is a schematic plan view showing an operation panel in a state where an "auxiliary power source setting" screen is displayed on a display unit of a second embodiment of the invention.

In the second embodiment, as shown in FIG. 15, an auxiliary power source setting mode as a setting state of an auxiliary power source device 64 is displayed on a display unit 121 of an operation panel 120. The display unit 121 displays, in addition to this, for example, the number of prints (number of copies), a setting menu, a guide message and the like. Besides, the operation panel 120 is provided with, in addition to the display unit 121, a numeric keyboard, a menu item key 123 for switching states of printer, copy, fax and the like, a start key 124 for starting printing, and the like. Incidentally, the display unit 121 is of a touch panel type in which an input operation can be made by touching a display surface.

The menu item key 123 of the operation panel 120 is selected, or the input key displayed on the display unit 121 is touch-operated, so that the menu is sequentially displayed on the display unit 121. By this, as an auxiliary power source function setting mode, an "auxiliary power source setting" screen is displayed on the display unit 121. On this "auxiliary power source setting" screen, item keys such as, for example, "auxiliary power source is not used" (item key 122*a*), "charging during standby" (item key 122*b*), "setting is initialized at time of mounting" (item key 122*c*), "default" (item key 122*d*), and "return" (item key 122*e*) are displayed.

By the item key 122*a* of "auxiliary power source is not used", in the case where the auxiliary power source device 64 is mounted in the image forming apparatus 1, it is possible to perform setting that the auxiliary power source device 64 is "used" or "not used". The setting that the auxiliary power source device 64 is "used" or "not used" is performed by using the item key 122*a* of "auxiliary power source is not used". For example, when the item key 122*a* of "auxiliary power source is not used" is once selected, setting is made such that the auxiliary power source device 64 is not used. Besides, when the item key 122*a* of "auxiliary power source is not used" is once more selected, the selection of the item key 122*a* of "auxiliary power source is not used" is released. In the case where the item key 122*a* is not selected, setting is made such that the auxiliary power source device 64 is used.

Incidentally, in the case where the auxiliary power source device 64 is not mounted in the image forming apparatus 1, setting may be made such that the item key 122*a* of "auxiliary power source is not used" can not be selected. Besides, the setting of "auxiliary power source is not used" by the item key 122*a* of "auxiliary power source is not used" may be set by the user side. Further, the setting may be made at the time of shipping of the product, or the setting may be changed according to the desire of the user at the time of maintenance.

The item key 122*b* of "charging during standby" is for performing setting that "charging is performed" or "charging is not performed" in the capacitor 71 in the case where the auxiliary power source device 64 is mounted in the image forming apparatus 1 and it is selected that the auxiliary power source device 64 "is not used". For example, when the item key 122*b* of "charging during standby" is once selected, setting is made such that "charging is performed" at the time of standby mode. Further, the item key 122*b* of "charging during standby" is once more selected, the selection of the item key 122*b* of "charging during standby" is released. In the case where the item key 122*b* of "charging during standby" is not selected, setting is made such that charging is not performed even at the time of standby mode. That is, in the case where setting is made such that the auxiliary power source device 64 is "not used", and the capacitor 71 is not fully charged, when setting of "charging is performed" is made by the item key 122*b* of "charging during standby", the charging of the capacitor 71 is performed.

On the other hand, in the case where the auxiliary power source device 64 is "used", as shown in the first embodiment, charging is performed at the time of standby mode. Incidentally, in this second embodiment, in the case where setting that the auxiliary power source device 64 is "not used" is made by the item key 122*a* of "auxiliary power source is not used", the item key 122*b* of "charging during standby" can be selected. However, irrespective of "presence or absence of use" of the auxiliary power source device 64 set by the item key 122*a* of "auxiliary power source is not used", the item key 122*b* of "charging during standby" may be selected.

The item key 122*c* of "setting is initialized at time of mounting" is for performing selection of whether setting relating to the auxiliary power source device 64 is initialized in the case where the auxiliary power source device 64 is detached from or attached to the image forming apparatus 1. For example, when the item key 122*c* of "setting is initialized at time of mounting" is once selected, when the auxiliary power source device 64 is mounted in the image forming apparatus 1, setting is made such that setting relating to the auxiliary power source device 64 is initialized. By this initialization, the selections of the item key 122*a* of "auxiliary power source is not used" and the item key 122*b* of "charging during standby" are released. Further, when the item key 122*c* of "setting is initialized at time of mounting" is once more selected, the selection of the item key 122*c* of "setting is initialized at time of mounting" is released. In the case where the item key 122*c* of "setting is initialized at time of mounting" is not selected, when the auxiliary power source device 64 is mounted in the image forming apparatus 1, setting relating to the auxiliary power source device 64 is not initialized. That is, for example, in the case where the auxiliary power source device 64 is exchanged, the setting relating to the auxiliary power source device 64, which was selected before the exchange of the auxiliary power source device 64, is maintained. Accordingly, also in the case where the attachment or detachment of the auxiliary power source device 64 occurs, the setting meeting the user's demand can be maintained, and the usability becomes good.

When the item key 122*d* of "default" is selected, the setting relating to the auxiliary power source device 64 is initialized. By this initialization, the selections of the item key 122*a* of "auxiliary power source is not used", the item key 122*b* of "charging during standby" and the item key 122*c* of "setting is initialized at time of mounting" are released. When the item key 122*e* of "return" is selected, the screen of the display unit 121 is shifted to the setting menu screen of the immediately preceding screen hierarchy. The setting content selected on the "auxiliary power source setting" screen is stored in the storage unit 110.

Next, with respect to the operation of power supply to the first and the second heaters 50 and 51 of the fixing device 34 of the image forming apparatus 1, portions different from the first embodiment will be described with reference to flowcharts shown in FIG. 16 and FIG. 17.

Figure 16:
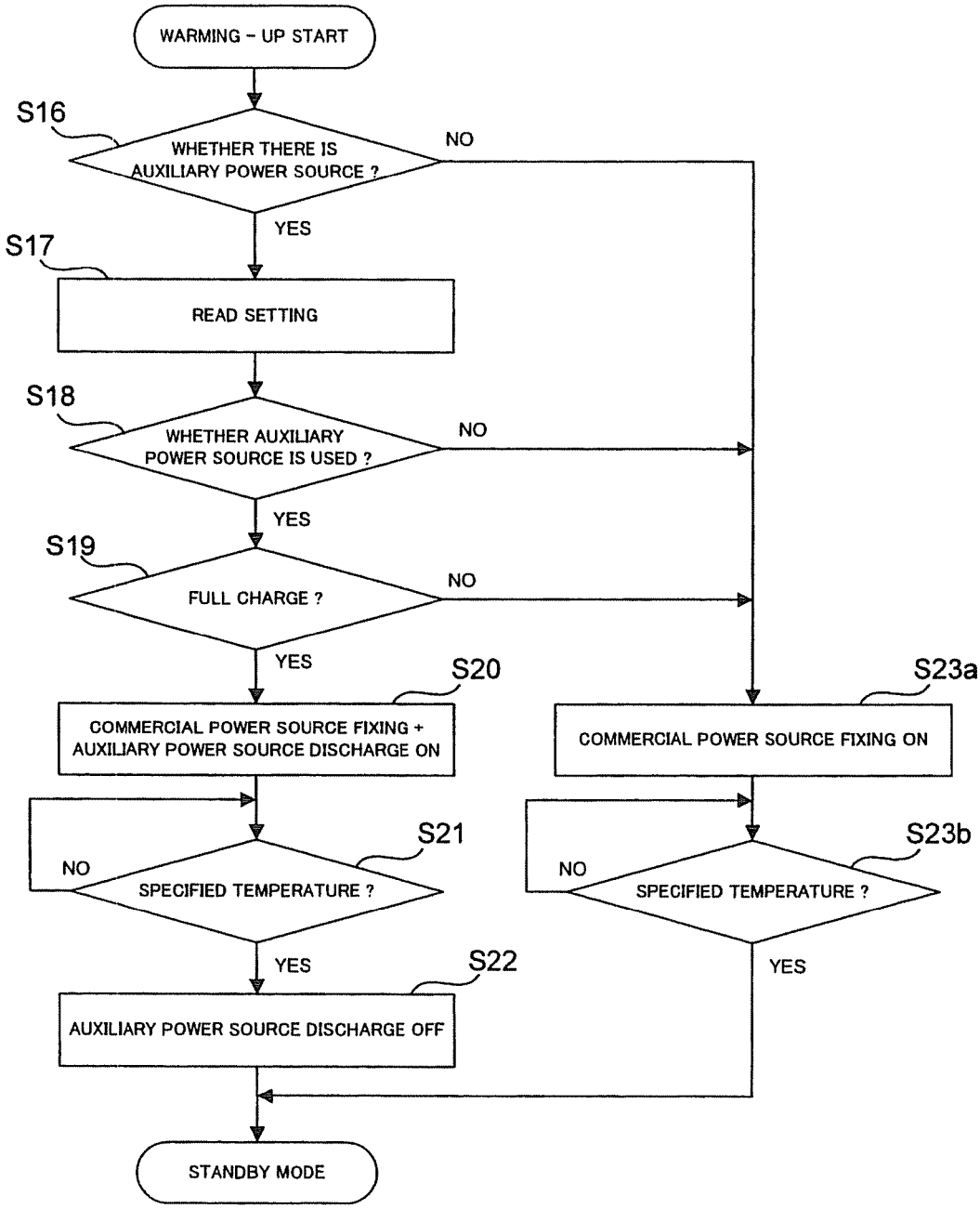
FIG. 16 is a flowchart showing an operation at the time of warming-up of an image forming apparatus of the second embodiment of the invention.
Figure 17:
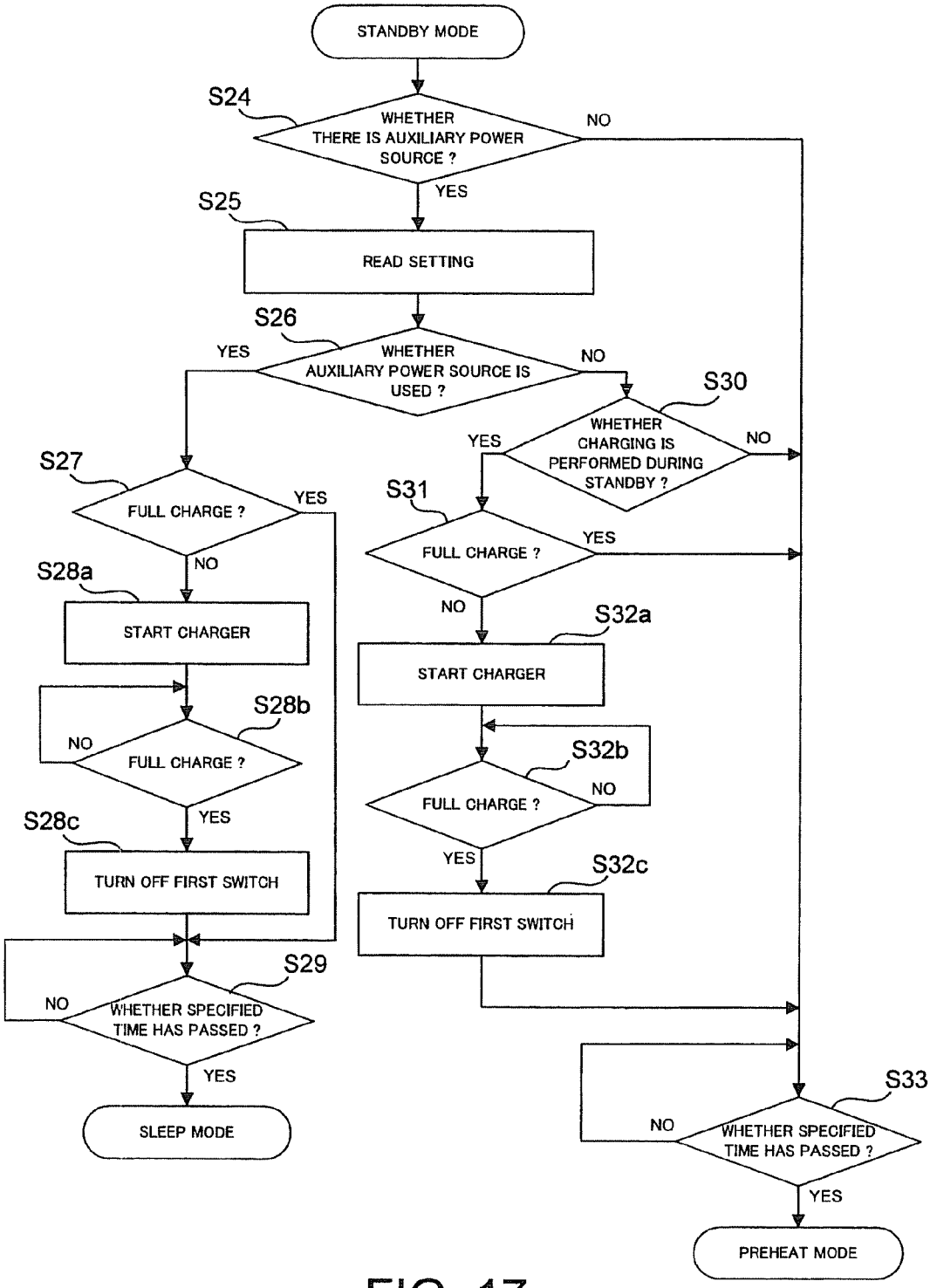
FIG. 17 is a flowchart showing an operation, at the time of charging, of an auxiliary power source device of the image forming apparatus of the second embodiment of the invention.

First, the flowchart of FIG. 16 is for explaining the operation of the image forming apparatus 1 at the time of warming-up. The warming-up is started when the main power source 201 of the image forming apparatus 1 is turned on or at the time of return from the sleep mode. When the warming-up starts, the main body control unit 65 detects the presence or absence of mounting of the auxiliary power source device 64 (step S16). In the case where the auxiliary power source device 64 is mounted in the image forming apparatus 1, and the main body control unit 65 detects the auxiliary power source device 64 at step S16, the main body control unit 65 reads the setting content of the auxiliary power source function setting mode stored in the storage unit 110 (step S17). The setting content previously selected by the user from the "auxiliary power source setting" screen displayed on the display unit 121 or initialized content is stored in the storage unit 110.

Next, the main body control unit 65 determines which of "using" and "not using" of the auxiliary power source device 64 is set (step S18). In the case where setting is made such that the auxiliary power source device 64 is "used", the main body control unit 65 determines the charge amount of the capacitor 71 (step S19). In the case where the capacitor 71 is fully charged, power is supplied from the main power source device 67 to the first heater 50, and power of the capacitor 71 of the auxiliary power source device 64 is supplied to the second heater 51 through the discharger 90 (step S20). By this, heating of the heat roller 37 and the press roller 38 is started. Until the surface temperature of the heat roller 37 becomes the specified fixing temperature, power supply is continued from the main power source device 67 and the auxiliary power source device 64 to the first heater 50 and the second heater 51 (step S21).

When the temperature detection member 44 detects that the surface temperature of the heat roller 37 reaches the specified fixing temperature, the power supply from the auxiliary power source device 64 to the second heater 51 is stopped (step S22). At this time, the heat roller 37 is immediately brought into the printable state, and then, a shift is made to the standby mode so that in the case where a print instruction is issued, printing can be immediately performed.

On the other hand, in the case where the main body control unit 65 does not detect the auxiliary power source device 64 at step S16, in the case where it is set at step S18 that the auxiliary power source device 64 is "not used", or in the case where the capacitor 71 is not fully charged at step S19, only the power supply to the first heater 50 by the main power source device 67 is performed (step S23*a*). By this, heating of the heat roller 37 is started. When it is detected that the surface temperature of the heat roller 37 reaches the specified fixing temperature (step S23*b*), thereafter, a shift is made to the standby mode in which the power supply to the first heater 50 is controlled so that the surface temperature of the heat roller 37 is kept at the specified fixing temperature.

Next, the operation of the auxiliary power source device 64 at the time of charging will be described with reference to the flowchart of FIG. 17. Incidentally, in FIG. 17, the description will be made on the assumption that a print instruction is not issued during the standby mode. During the period when the image forming apparatus 1 holds the standby mode, the main body control unit 65 determines the presence or absence of mounting of the auxiliary power source device 64 (step S24). In the case where mounting of the auxiliary power source device 64 is detected at step S24, the main body control unit 65 reads the setting content of the auxiliary power source function setting mode stored in the power storage unit 110 (step S25). Next, from the read setting content, the main body control unit 65 determines which of "using" and "not using" of the auxiliary power source device 64 is set (step S26). In the case where the setting is made such that the auxiliary power source device 64 is "used", the main body control unit 65 determines the charge amount of the capacitor 71 (step S27). In the case where the capacitor 71 is not fully charged, the main body control unit 65 turns on the first switch 87 to start the charger 80 and charges the capacitor 71 (step S28*a*).

Next, when it is determined that the capacitor 71 reaches full charge (step S28*b*), the first switch 87 is turned off and the charging operation of the capacitor 71 is ended (step S28*c*). Thereafter, it is determined whether the specified time has passed in the standby mode (step S29). In the case where the specified time has passed in the standby mode, power supply to the first heater 50 is cut off, and then, a shift is made to the sleep mode.

On the other hand, at step S26, in the case where the setting is made such that the auxiliary power source device 64 is "not used", the main body control unit 65 determines from the read setting content which of "charging" and "not charging" of the capacitor 71 during the standby mode is set (step S30). In the case where "charging" during the standby mode is set, the main body control unit 65 determines the charge amount of the capacitor 71 (step S31). In the case where the capacitor 71 is not fully charged, the main body control unit 65 turns on the first switch 87 to start the charger 80 and charges the capacitor 71 (step S32*a*). Next, when it is determined that the capacitor 71 reaches full charge (step S32*b*), the first switch 87 is turned off and the charge operation of the capacitor 71 is ended (step S32*c*). Thereafter, it is determined whether the specified time has passed in the standby mode (step S33) In the case where the specified time has passed in the standby mode, a shift is made to the preheat mode in which the surface temperature of the heat roller 37 is kept at the specified preheat temperature.

Incidentally, in the case where at step S24, the main body control unit 65 does not detect the auxiliary power source device 64, in the case where at step S30, it is set that the capacitor 71 is "not charged" during the standby mode, or in the case where at step S31, the capacitor 71 is not fully charged, it is determined whether the specified time has passed in the standby mode (step S33). In the case where the specified time has passed in the standby mode, a shift is made to the preheat mode.

According to the image forming apparatus 1 of the second embodiment, similarly to the first embodiment, it is possible to suitably satisfy demands of various users such as the user who desires low cost at the time of purchase of the image forming apparatus 1, the user who desires energy saving, and the user who desires energy saving after the purchase of the image forming apparatus 1, better service can be provided, and the optimum power saving at that time can be realized. Besides, the image forming apparatus 1 can perform printing without being influenced by the auxiliary power source device 64.

Further, according to this second embodiment, in the case where the auxiliary power source device 64 is mounted in the image forming apparatus 1, with respect to "using" or "not using" of the auxiliary power source device 64, the user can arbitrarily select. By this, more flexible measures for the user's demand can be taken. Besides, in the case where selection is made such that the auxiliary power source device 64 is "not used", with respect to "charging" or "not charging" of the capacitor 71 during the standby mode, the user can arbitrarily select. Accordingly, for example, when setting is made such that the capacitor 71 is "charged" during the standby mode and the capacitor 71 is charged, also in the case where the "auxiliary power source setting" is changed such that the auxiliary power source device 64 is "used", it becomes possible to take such a measure that at the time of warming-up, power is immediately supplied from the auxiliary power source device 64. Further, whether "setting is initialized at time of mounting" can be arbitrarily selected, and when the auxiliary power source device 64 is detached from or attached to the image forming apparatus 1 by exchange or the like, the setting relating to the auxiliary power source device 64 and meeting the user's demand can be easily obtained, and the usability can be improved.

Incidentally, the invention is not limited to the above embodiments, and various modifications can be made within the scope of the invention. For example, a structure may be made such that the attachment and detachment of the auxiliary power source unit to and from the apparatus main body can be performed by only a specific person such as a service man, not a user. Besides, the image formation unit of the apparatus main body is also arbitrary, for example, a color image is supported. Further, the structure of the display unit and the operation unit is also not limited, and for example, the display unit is not of the touch panel type, but may have simply a display function. Further, no limitation is made also to the display form or display content of the auxiliary power source function setting mode of the second embodiment.

What is claimed is:

1. An image forming apparatus comprising:

an apparatus main body having an image formation unit;

a main power source unit that is mounted in the apparatus main body and supplies power to a heat source of a fixing device;

an auxiliary power source unit detachably mounted in the apparatus main body; and a control unit configured to bring the heat source to a printable state by an operation of a warming-up, configured to stop or modulate power supplied to the heat source after a specified time has passed while the heat source of the fixing device is in the printable state, configured to stop power supplied to the heat source of the fixing device by the main power source unit, after a specified time has passed while the heat source of the fixing device is in the printable state while the auxiliary power source unit is mounted in the apparatus main body, and configured to adjust power supply of the main power source unit to the heat source of the fixing device to cause the fixing device to keep a preheat temperature, and further, after a specified time has passed with the fixing device kept at the preheat temperature, to stop the power supply of the main power source unit to the heat source of the fixing device, after the specified time has passed while the heat source of the fixing device is in the printable state while the auxiliary power source unit is not mounted in the apparatus main body.

2. The image forming apparatus according to claim 1, wherein the auxiliary power source unit includes a power storage member, and when the auxiliary power source unit is mounted in the apparatus main body, and a charge amount of the power storage member is sufficient to supply power to the heat source of the fixing device, the auxiliary power source unit, together with the main power source unit, supplies the power to the heat source of the fixing device.

3. The image forming apparatus according to claim 2, wherein at a time of warming-up of the image formation unit, the auxiliary power source unit, together with the main power source unit, supplies the power to the heat source of the fixing device.

4. The image forming apparatus according to claim 1, wherein the auxiliary power source unit includes a power storage member, and when the auxiliary power source unit is mounted in the apparatus main body, the power storage member is charged during a period when the heat source of the fixing device is in a printable state.

5. The image forming apparatus according to claim 1, wherein the auxiliary power source unit includes a power storage member, a charge member that receives power supply from a commercial power source and supplies power to the power storage member, and a discharge member that supplies the power from the power storage member to the heat source of the fixing device.

6. The image forming apparatus according to claim 5, wherein the charge member includes a charging control power source and the discharge member includes a discharging control power source.

7. The image forming apparatus according to claim 1, wherein as an option, the auxiliary power source unit can be attached to and detached from the apparatus main body.

8. The image forming apparatus according to claim 1, further comprising a display unit configured to display whether the auxiliary power source unit is mounted in the apparatus main body.

9. An image forming apparatus comprising:

an apparatus main body having an image formation unit;

a main power source unit that is mounted in the apparatus main body and supplies power to a heat source of a fixing device;

an auxiliary power source unit detachably mounted in the apparatus main body;

a control unit configured to bring the heat source to a printable state, and to switch a power supply operation of the main power source unit to the heat source of the fixing device according to whether the auxiliary power source unit is mounted in the apparatus main body, configured to stop the power supply of the main power source unit to the heat source of the fixing device after a specified time has passed with the main power source unit turned on when the auxiliary power source unit is mounted in the apparatus main body and after the heat source of the fixing device comes to a printable state and the main power source unit is turned on to maintain the printable state, and configured to adjust power supply of the main power source unit to the heat source of the fixing device to cause the fixing device to keep a preheat temperature, and further, after a specified time has passed with the fixing device kept at the preheat temperature, to stop the power supply of the main power source unit to the heat source of the fixing device when the auxiliary power source unit is not mounted in the apparatus main body after the heat source of the fixing device has come to the printable state; and a storage unit configured to store setting information of the auxiliary power source unit whether the auxiliary power source unit is used or not in a case where the auxiliary power source unit is mounted in the apparatus main body.

10. The image forming apparatus according to claim 9, when the auxiliary power source is mounted in the apparatus main body, the setting information is set to use the auxiliary power unit, and after the heat source of the fixing device comes to the printable state and the main power source unit is turned on to maintain the printable state, the control unit is further configured to stop power supply of the main power source unit to the heat source of the fixing device after a specified time has passed with the fixing device maintained in the printable state.

11. The image forming apparatus according to claim 9, when the auxiliary power source is mounted in the apparatus main body, the setting information is not set to use the auxiliary power unit, and after the heat source of the fixing device comes to the printable state and the main power source unit is turned on to maintain the printable state, the control unit is further configured to adjust power supply of the main power source unit to the heat source of the fixing device to cause the fixing device to keep a preheat temperature, and further, after a specified time has passed with the heat source maintained at the preheat temperature, to stop the power supply of the main power source unit to the heat source of the fixing device.

12. The image forming apparatus according to claim 10, wherein the auxiliary power source unit includes a power storage member when a charge amount of the power storage member is sufficient to supply power to the heat source of the fixing device, the auxiliary power source unit, together with the main power source unit, supplies the power to the heat source of the fixing unit.

13. The image forming apparatus according to claim 12, wherein at a time of warming-up of the image formation unit, the auxiliary power source unit, together with the main power source unit, supplies the power to the heat source of the fixing device.

14. The image forming apparatus according to claim 10, wherein the auxiliary power source unit includes a power storage member, the power storage member is charged during a period when the heat source of the fixing device is in a printable state.

15. The image forming apparatus according to claim 9, wherein as an option, the auxiliary power source unit is attachable to and detachable from the apparatus main body.

16. The image forming apparatus according to claim 9, further comprising an operation unit configured to change the setting information of the auxiliary power source unit.

17. The image forming apparatus according to claim 16, wherein the operation unit displays whether the auxiliary power source unit is used or not.

18. A control method of an image forming apparatus, comprising:

detecting whether an auxiliary power source unit to supply power to a heat source of a fixing device is mounted in an apparatus main body having an image formation unit;

bringing the heat source of the fixing device to a printable state by supplying power from a main power source unit to the heat source of the fixing device;

the auxiliary power source unit is detected to be mounted in the apparatus main body, stopping the power supply of the main power source unit to the heat source of the fixing device, the stopping of power supply to the main power source unit occurring after the heat source of the fixing device is brought to a printable state and maintains the printable state for a specified time; and the auxiliary power source is detected to be not mounted in the apparatus main body, adjusting power supply of the main power source unit to the heat source of the fixing device to cause the fixing device to keep a preheat temperature, the adjusting of the main power source unit to maintain a preheat temperature occurring after the heat source of the fixing device is brought to a printable state and maintains the printable state for a specified time, and further, after a specified time has passed with the heat source maintained at the preheat temperature, stopping the power supply of the main power source unit to the heat source of the fixing device.

19. The control method of the image forming apparatus according to claim 18, wherein when it is detected that the auxiliary power source unit is mounted, and the auxiliary power source unit can supply the power to the heat source of the fixing device, the auxiliary power source unit, together with the main power source unit, supplies the power to the heat source of the fixing device.

20. The control method of the image forming apparatus according to claim 19, wherein at a time of warming-up of the image formation unit, the auxiliary power source unit, together with the main power source unit, supplies the power to the heat source of the fixing device.

21. The control method of the image forming apparatus according to claim 18, wherein in a case where it is detected that the auxiliary power source unit is mounted, the auxiliary power source unit is charged during a period when the heat source of the fixing device is in a printable state.

* * * * *